US006955119B2

(12) United States Patent
Bobren et al.

(10) Patent No.: US 6,955,119 B2
(45) Date of Patent: Oct. 18, 2005

(54) STRAPPING MACHINE WITH PIVOTAL WORK SURFACES HAVING INTEGRAL CONVEYORS

(75) Inventors: Allan J. Bobren, Streamwood, IL (US); Christopher S. Krohn, New Lenox, IL (US); Timothy B. Pearson, Antioch, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 24 days.

(21) Appl. No.: 10/701,729

(22) Filed: Nov. 5, 2003

(65) Prior Publication Data

US 2004/0255797 A1 Dec. 23, 2004

Related U.S. Application Data

(60) Provisional application No. 60/479,231, filed on Jun. 17, 2003.

(51) Int. Cl.[7] ..... B65B 13/04; B65B 13/32

(52) U.S. Cl. ..... 100/7; 100/18; 100/26; 100/29; 53/589; 198/592; 198/861.5

(58) Field of Search ..... 100/7, 8, 13, 18, 100/26, 29; 53/589, 590; 198/592, 860.2, 861.1, 861.4, 861.5; 186/68

(56) References Cited

U.S. PATENT DOCUMENTS 3,330,205 A * 7/1967 Smith ..... 100/4
4,392,553 A * 7/1983 Foster ..... 186/61
4,474,288 A * 10/1984 Majewski ..... 198/816
4,769,970 A 9/1988 Konno
6,363,689 B1 * 4/2002 Rodriguez et al. ..... 53/399

FOREIGN PATENT DOCUMENTS

| | | |
|---|---|---|
| DE | 19607084 | 8/1997 |
| EP | 0738658 | 10/1996 |
| GB | 1120778 | 7/1968 |

OTHER PUBLICATIONS

Patent Abstracts of Japan 2000109013.
Eurpoean Search Report Ref No. 04.19296EP S/g.

* cited by examiner

*Primary Examiner*—Derris H. Banks
*Assistant Examiner*—Jimmy Nguyen
(74) *Attorney, Agent, or Firm*—Mark W. Croll, Esq.; Donald J. Breh, Esq.; Welsh & Katz, Ltd.

(57) ABSTRACT

A strapping machine configured to feed a strapping material around a load, position, tension and seal the strapping material around the load, includes hinged, readily removable in-feed and out-feed work surfaces with integral conveyors. The strapping machine includes a machine frame, the in-feed and out-feed work surfaces mounted to the frame and a strap chute mounted to the frame for carrying the strap around the load and for releasing the strap material from the strap chute. A feed assembly and a weld head are disposed below the work surfaces. The in-feed and out-feed surfaces are on opposite sides of the strap chute and are separated from one another by a lower portion of the chute. Integral conveyors for in-feeding the load into the strapping machine and for out-feeding the load from the strapping machine are formed in the work surfaces. The work surfaces are hingedly mounted for pivoting upwardly and outwardly for maintenance of the machine and for removing the surfaces and conveyors from the machine.

7 Claims, 20 Drawing Sheets

FIG. 4
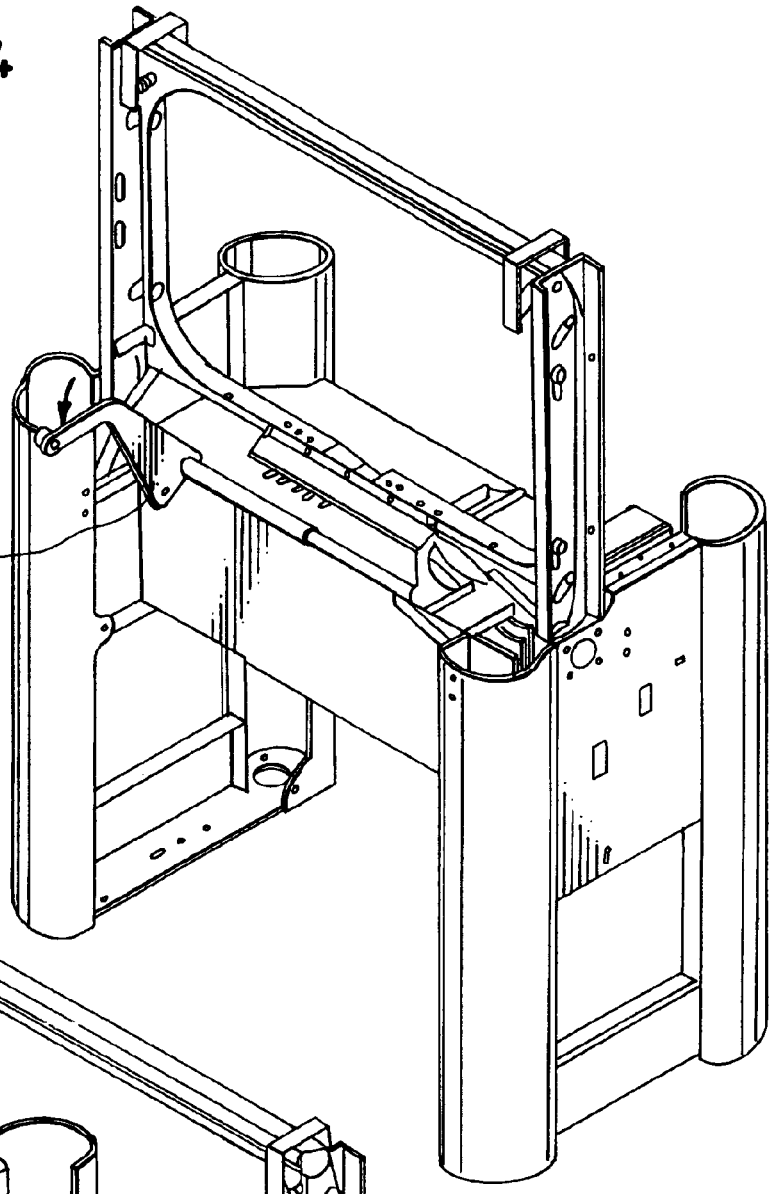
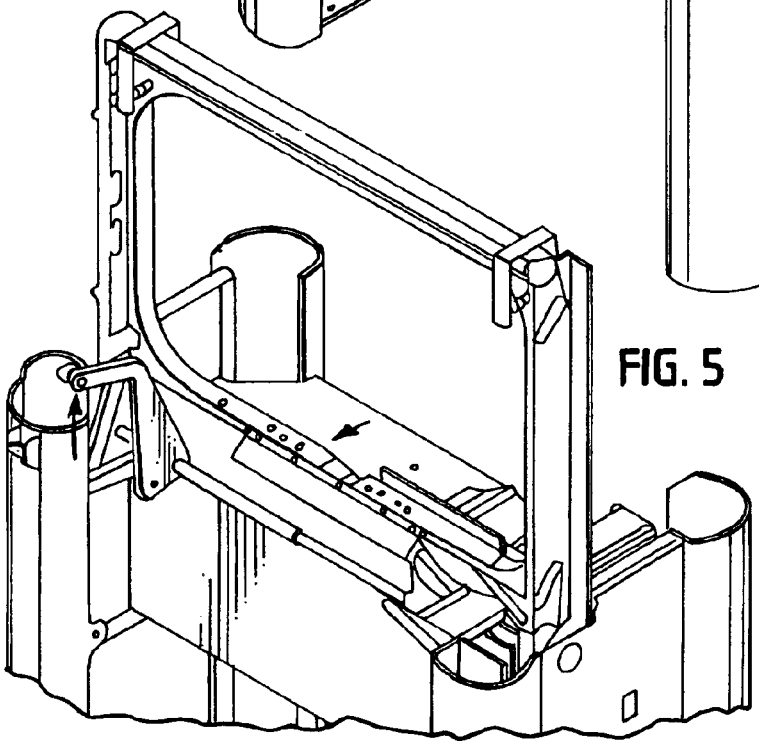
FIG. 5

FIG. 8
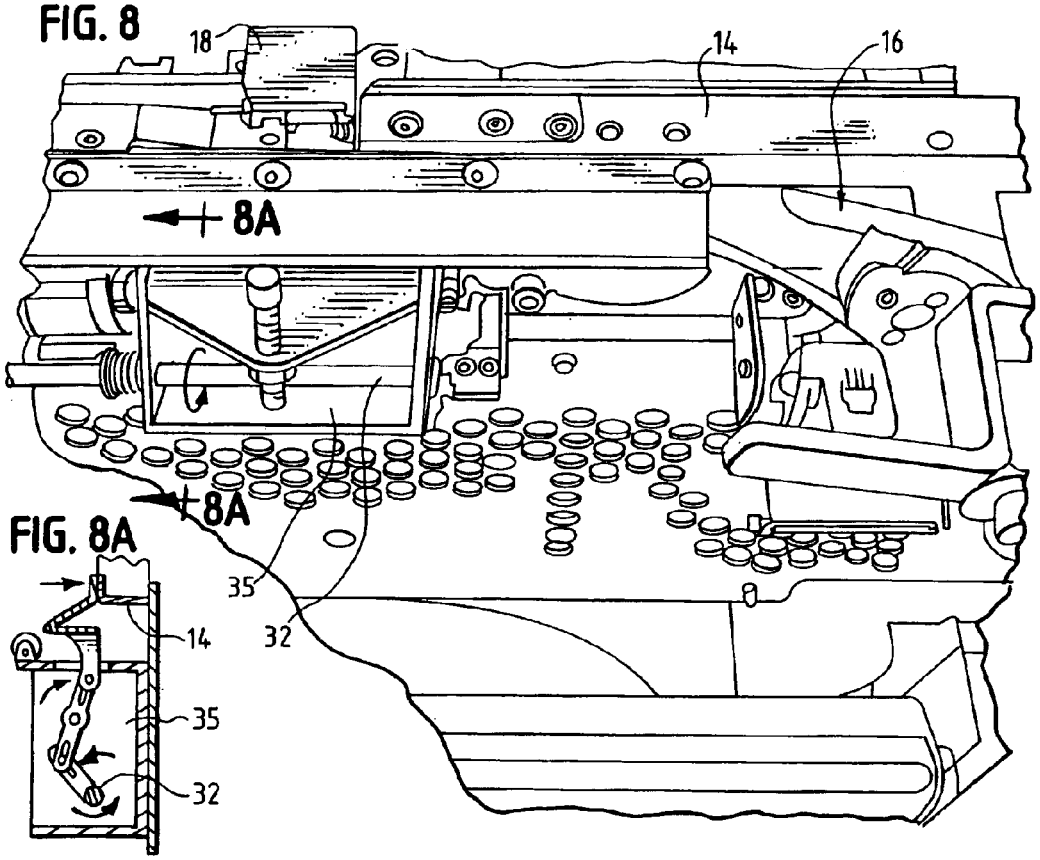
FIG. 8A
FIG. 9
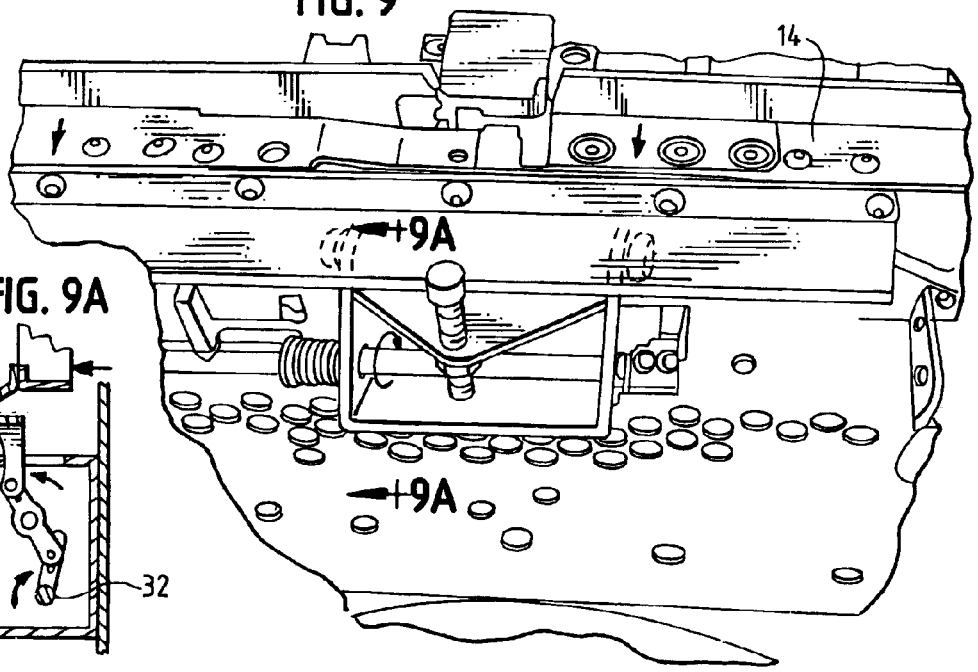
FIG. 9A
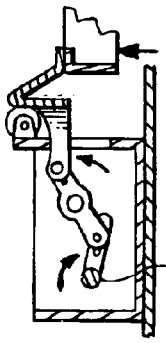

18
18
14
46
52
70

16
16
54
58
51
56
50
48
64
68
60
62
66

56
54
58
52

22
12
134
130
132
136
118
112
120
128
114
116
10

STRAPPING MACHINE WITH PIVOTAL WORK SURFACES HAVING INTEGRAL CONVEYORS

CROSS REFERENCE TO RELATED APPLICATION DATA

This application claims the benefit of priority of U.S. Provisional Patent Application Ser. No. 60/479,231, filed Jun. 17, 2003.

BACKGROUND OF THE INVENTION

The present invention is directed to an improved strapping machine. More particularly, the present invention is directed to a strapping machine having pivotal work surfaces with integral conveyors.

Strapping machines are in widespread use for securing straps around loads. One type of known strapper includes a strapping head and drive mechanism mounted within a frame. A chute is mounted to the frame, through which the strapping material is fed.

In a typical stationary strapper, the chute is mounted at about a work surface, and the strapping head is mounted to a horizontal portion of the chute, below the work surface. The drive mechanism is also mounted below the work surface, near to the strapping head. The drive mechanism "pulls" or feeds strap material from a source, such as dispenser into the machine. The drive mechanism urges or feeds the strap through the strapping head, into and around the chute, until the strap material returns to the strapping head. The drive mechanism also retracts the strap material to tension the strap around the load.

During the retraction or tensioning portion of the strapping cycle, the strap material must be released from the chute. A typical chute includes inner and outer walls that define a pathway around which the strap is fed. The inner wall (that wall closest to the load), is generally movable so that as the strap is "pulled", the inner wall moves out of the way (from between the strap and the load), and the strap thus tensions around the load. In some configurations, the inner and outer walls are formed from a plurality of wall sections.

Known chute systems use a plurality of pins, generally located at about the corners of the chute, along with springs and torsion bars to locate and move the wall out of the strap path. While these known systems function well for their intended purposes, it is necessary to assure precise alignment of the pins, over the springs, and generally through openings in the walls or flanges that are formed as part of the walls. In addition, the torsion bars must all be configured so that the walls move in a predetermined sequence, a precise distance, to release the strap.

It has also been found that it is often necessary to access the strapping head (and more specifically the weld head) by removing portions of the work surface. This may be necessary to dislodge misfed strap, to clear the strapping head or weld head, or for general maintenance or repair of the machine. Quite often, it is necessary to access the strap path (by moving the strap chute) at the weld head.

In known strapping machines, to access the strap path it was necessary to move the strap chute by some manual means. For example, known machines include doors or panels that require removal to access these areas of the machine. Others include sprung or biased doors that are biased closed and thus must be held open to access these machine areas.

The strapping or welding head provides a number of functions. First, the strapping head includes a gripper for gripping the strap during the course of a strapping operation. The strapping head also includes a cutter to cut the strap from a strap source or supply. Last, the strapping head includes a sealer to seal a course of strapping material onto another course of material. This seal is commonly referred to as a weld and is effected by heating the overlying courses of the strap. One known heating method is the use of an electrically heated element, referred to as a weld blade or hot blade that is applied to facing sides of overlying courses of strap material. During machine operations, it has been observed that the weld blade can require cleaning fairly often (cleaning is typically carried out by lightly rubbing with an abrasive such as emery cloth).

In known strapping machines, the weld blade is fixed to the strapping head as by fastening to a support. In order to inspect or maintain the weld blade, a multitude of fasteners, such as screws and bolts must be removed from the weld head and support and the blade removed from the head. This can be quite time consuming particularly if, as often happens, the weld blade requires frequent cleaning.

Many such machines are employed in processes that maximize the use of fully automated operation. To this end, machines are configured for automated in-feed and out-feed, such that a load (to be strapped) is automatically fed into the machine by an in-feed conveyor, the strapping process is carried out, and the strapped load is automatically fed out of the machine by an out-feed conveyor. The in-feed and out-feed conveyors are fitted onto the machine at the work surface at either side of the strap chute. Often, the conveyors form a part of the work surface. In this manner, the in-feed conveyor receives the load and moves it into the chute area, the load is strapped and the out-feed conveyor moves the load out of the chute area.

The conveyors can require maintenance on a more frequent basis than the strapper. In addition, in that the conveyor is a load-bearing surface, it may be subjected to additional stresses beyond those to which the machine, generally is subjected.

In addition, as with many process equipment items, strappers are typically manufactured having a predetermined height above the floor at which the work surface is set. However, in that the strapper may be incorporated into other processes or may be used in an area where the strapper work surface height is critical, it may be necessary to vary the height of the strapper. Known machines have no "easy" way to make such height adjustments.

Accordingly there is a need for an improved strapping machine that promotes ready operation and maintenance. Desirably, such a machine includes pivotal, lift-off in-feed and out-feed work surfaces. More desirably, the work surfaces include integrated fully automatic in-feed and out-feed conveyors.

BRIEF SUMMARY OF THE INVENTION

A strapping machine configured to feed a strapping material around a load, position, tension and seal the strapping material around the load, includes pivotal, lift-off in-feed and out-feed work surfaces, which work surface preferably include integrated fully automatic in-feed and out-feed conveyors. The strapping machine includes a machine frame to which is mounted the in-feed and out-feed work surfaces.

A strap chute is mounted to the frame for carrying the strap around the load and for releasing the strap material from the strap chute. A feed assembly is configured to convey the strap around the strap chute and to retract and tension the strap around the load and a weld head is configured for sealing the strap to itself. The feed assembly and welding head are disposed, at least in part, below the work surface.

The work surface defines the in-feed surface on one side of the strap chute and the out-feed surface at an opposite side of the strap chute. The in-feed and out-feed surfaces are separated from one another by a lower portion of the strap chute.

One or both of the in-feed and out-feed surfaces includes an integral conveyor for feeding the load into the strapping machine (e.g., within the chute area) or for moving the load out of the strapping machine (e.g., from out of the chute area). The conveyor or conveyors are integral with the hinged work surface portion.

The hinged work surface portion is pivotal upwardly and outwardly from about the lower portion of the strap chute. The hinged work surface is removable, without tools, when in an upwardly pivoted orientation, by lifting the surface from the machine.

The work surfaces are pivotal about pairs of hinges. Each hinge includes a hinge pin disposed on the frame engageable with a hinge opening in the work surface. Preferably, the pins are formed having a pin stub and a centering flange at an end of the pin stub. In such an arrangement, the work surface includes a hinge opening for receiving the pin stub and an elongated slot contiguous with the hinge opening for receiving the centering flange.

In a present embodiment, the integral conveyor includes a conveyor belt and a conveyor motor mounted to the work surface. The electrical connections for the motor are provided on a quick disconnect fitting.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein:

FIG. 4 is a perspective view of the strapping machine chute opening system and chute track system showing the opening system moving toward the closed position;

FIG. 5 is a perspective view similar to FIG. 4 with the opening system moving toward the open position;

FIG. 8 is an enlarged partial view of the strap chute at the working surface, opposite of the welding head, and showing the cam arrangement for moving the chute for strap release (with the chute shown in the closed or operating position);

FIG. 8A is a cross-sectional view taken along line 8A—8A of FIG. 8;

FIG. 9 is a view of the strap chute at the working surface similar to FIG. 8 with the chute shown in the open or release position;

FIG. 9A is cross-sectional view taken along line 9A—9A of FIG. 9;

DETAILED DESCRIPTION OF THE INVENTION

Figure 1:
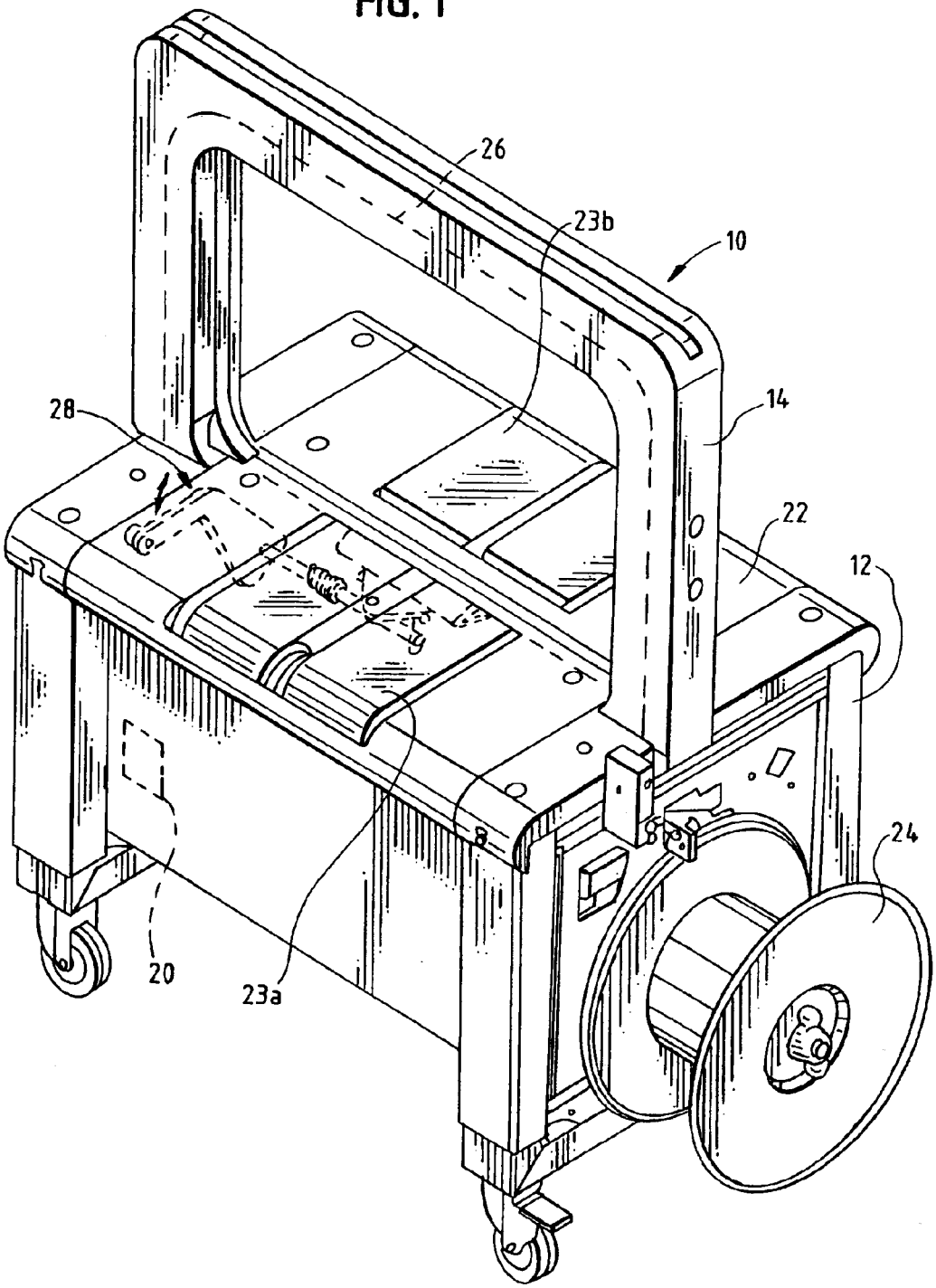
FIG. 1 is a perspective view of an exemplary strapping machine illustrating an automatic chute track opener system embodying one aspect of the present invention.
Figure 2:
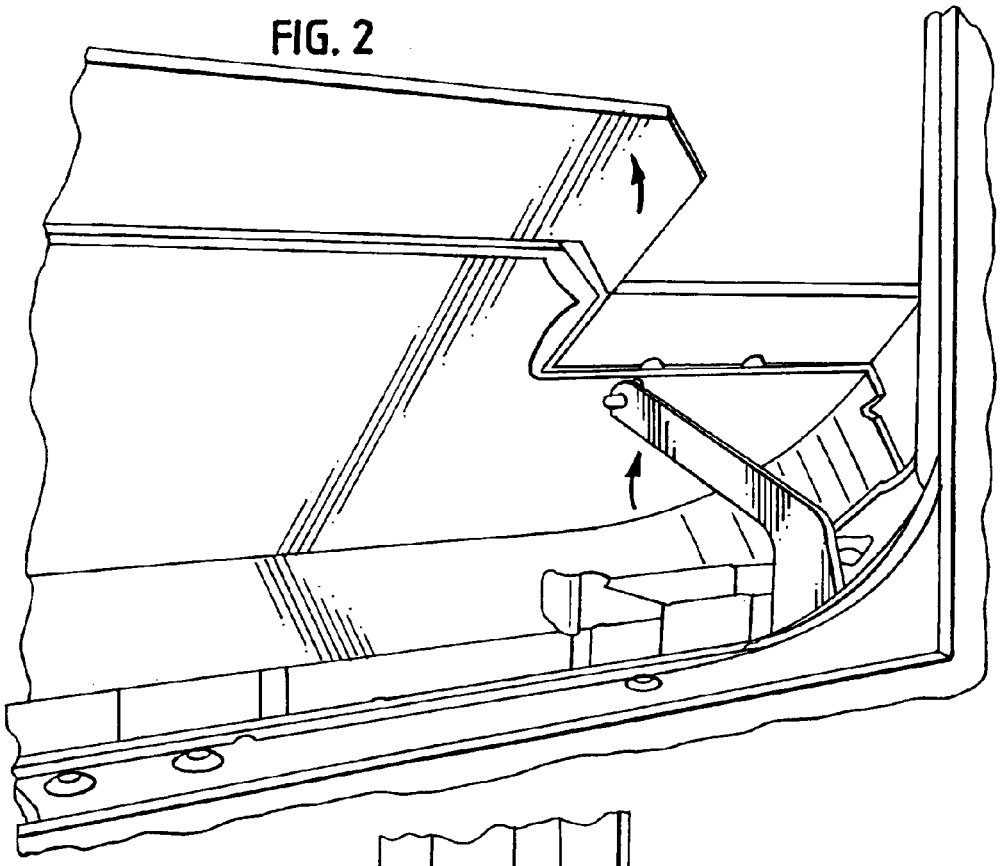
FIG. 2 is an enlarged, partial view of the automatic chute opening system illustrated with the automatic opening contact arm resting on the (opening) work surface or conveyor section.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring to the figures and in particular FIG. 1, there is shown a strapping machine 10 embodying the principles of the present invention. The strapping machine 10 includes, generally, a frame 12, a strap chute 14, a feed assembly 16 and a weld head 18. A controller 20 provides automatic operation and control of the strapper 10. A table top or work surface 22 is disposed on the strapper 10 at the bottom of the chute 14. A dispenser 24 supplies strapping material to the feed assembly 16 and weld head 18. The feed assembly 16 is shown in part in FIG. 8 and the weld head 18 is shown in part in FIGS. 32–38.

In one embodiment, the work surface 22, as will be discussed below, is configured having in-feed and out-feed conveyors 23*a,b*, respectively. That is, the conveyors 23*a,b* are formed as part of the work surface 22 and pivot upwardly and outwardly (relative to the strap chute 14) to provide access to the feed assembly 16 and the weld head 18. Those skilled in the art will recognize that in order to access the weld head 18 and the strap path (indicated generally at 26) at the chute 14/weld head 18 area, it is often necessary to "move" a portion of the strap chute 14 away from the weld head 18. In known machines this requires manually moving the chute out of the way.

Figure 10:
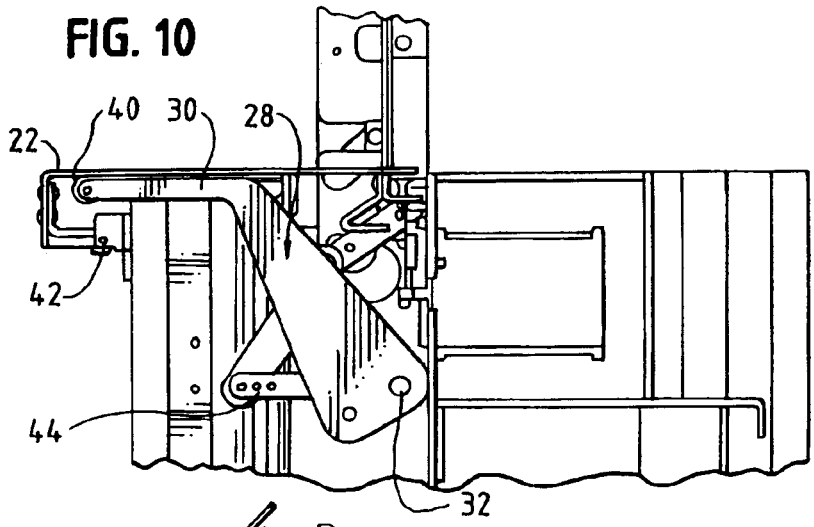
FIGS. 10–12 are side views, looking toward an inner surface of the chute and in partial cross-section of the work surface, showing the surface in the operating position, as it is pivoted upward, and in the fully upwardly pivoted position, and illustrating the chute track system position in each of the respective surface positions.
Figure 11:
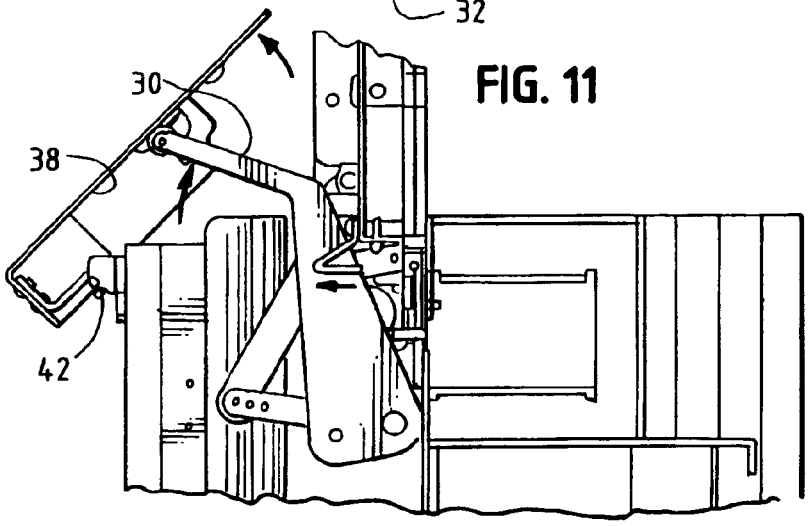
Figure 12:
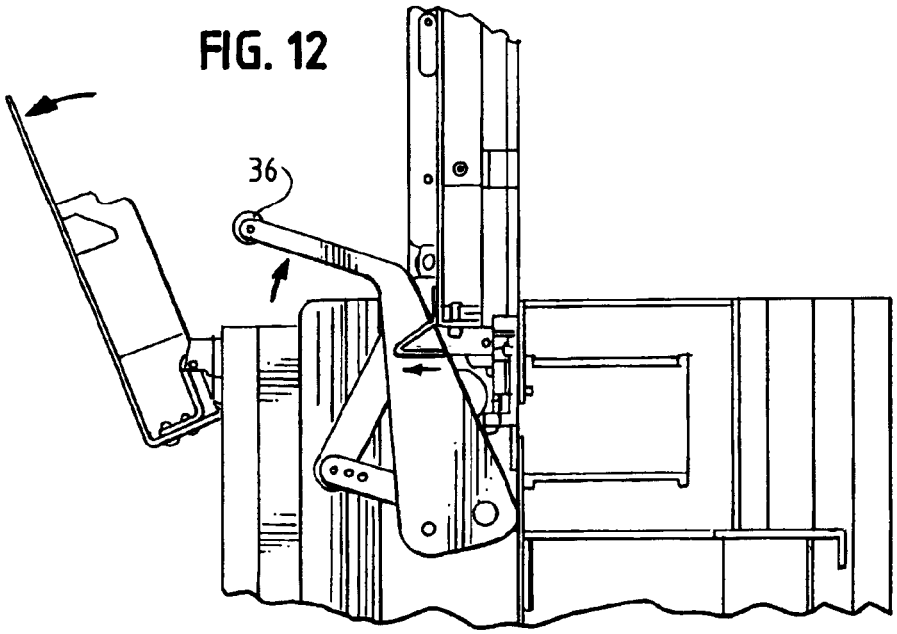
Figure 13:
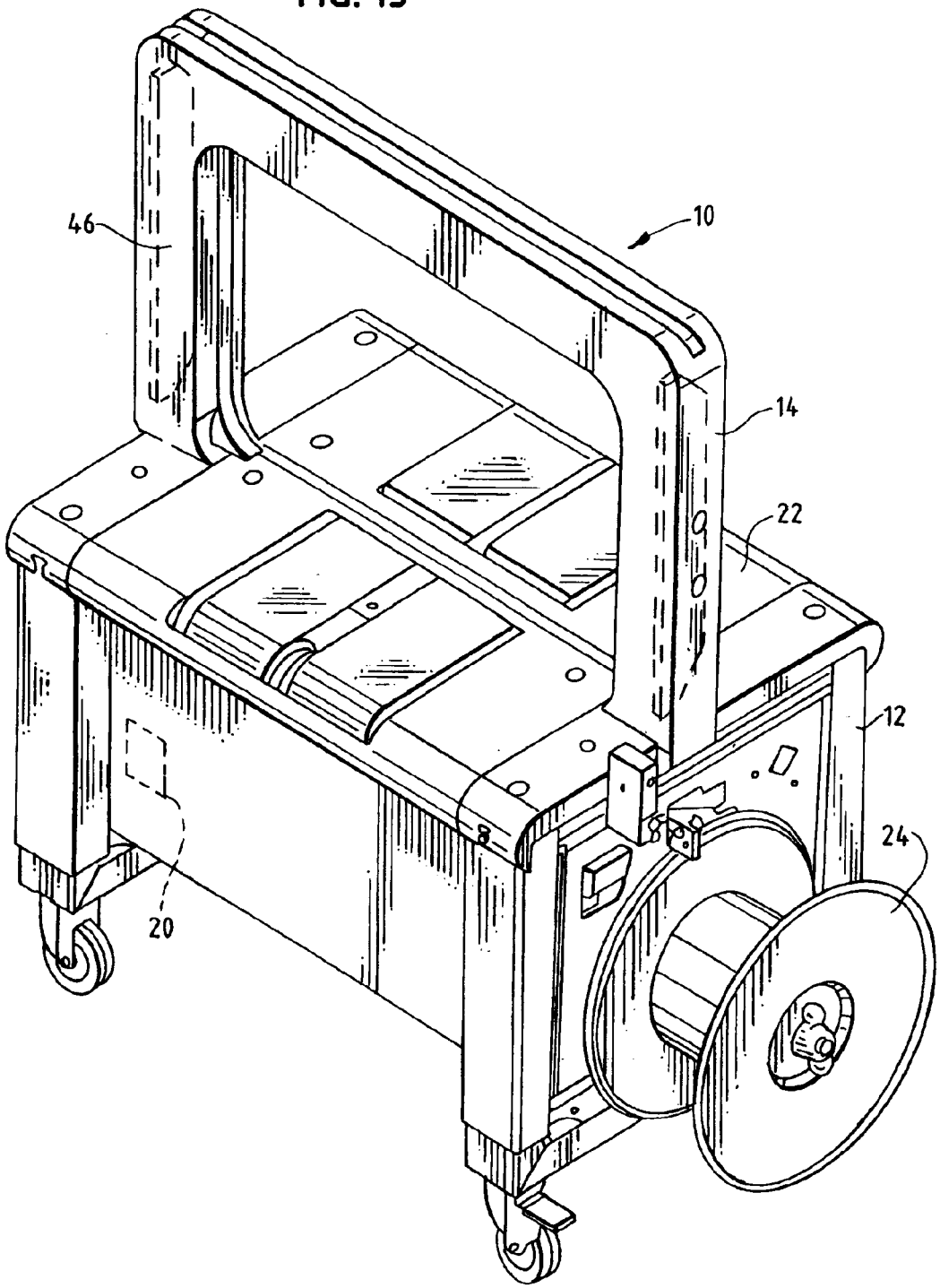
FIG. 13 is a perspective view of an exemplary strapping machine illustrating, in part, the chute track system aspect of the present invention.

The present strapping machine 10 includes an automatic chute opening system 28 that is operably connected to the work surface 22. The chute opening system 28 opens the chute 14 upon upward pivoting of the work surface 22. Referring briefly to FIGS. 10–12, there is shown a side view of the machine 10 with a portion of the work surface 22 in the closed position (FIG. 10) and as that portion of the surface 22 is pivoted upwardly (FIGS. 11–12). The chute opening assembly 28 includes a contact arm 30 that cooperates with the work surface 22 to rotate a torsion bar 32. The bar 32 is mounted to permit rotation within housing 35 (FIGS. 8–9A). During a normal strapping cycle, the torsion bar 32 is rotated by a cam (not shown) to open the strap chute 14 through operation of the chute opening assembly 28. The arm 30 is biased to the open position by a spring 34 that urges the arm 30 rearwardly (toward the chute 14).

As seen in FIGS. 7 and 10–12, the arm 30 includes a roller 36 at the end thereof that contacts and rides along a lower surface 38 of the work surface 22. The roller 36 assures that the contact between and movement of the arm 30 along the lower surface 38 remains smooth. Also as seen in FIGS. 10–12, when the work surface 22 is in the closed position, the contact location (as indicated generally at 40) of the roller 36 on the lower surface 38 is beyond the pivot point 42 for the work surface 22 (as the work surface 22 is pivoted upwardly). This provides a mechanical advantage in that the spring 34 bias of the arm 30 does not serve to urge the work surface 22 up or open when the surface 22 is fully down. Rather, because the arm 30 contacts the surface 22 on the "backside" of the pivot 42, it actually serves to urge the work surface 22 to the closed position.

Figure 3:
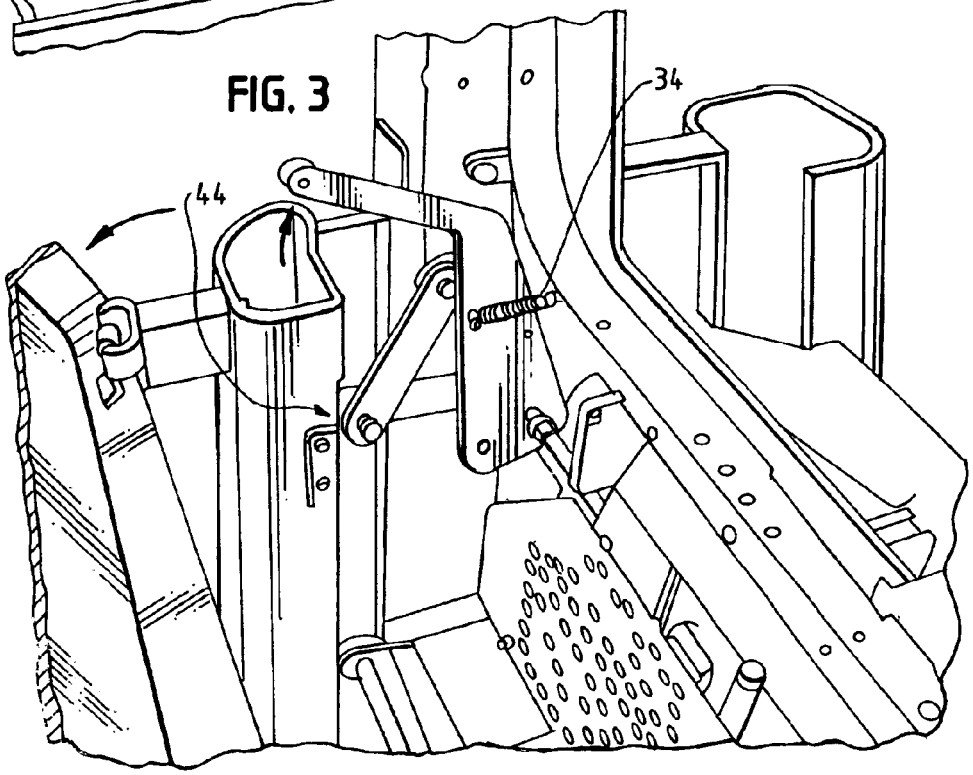
FIG. 3 is an enlarged perspective view of the chute opening system with the contact arm shown in the open orientation and the work surface fully lifted or pivoted upwardly.
Figure 6:
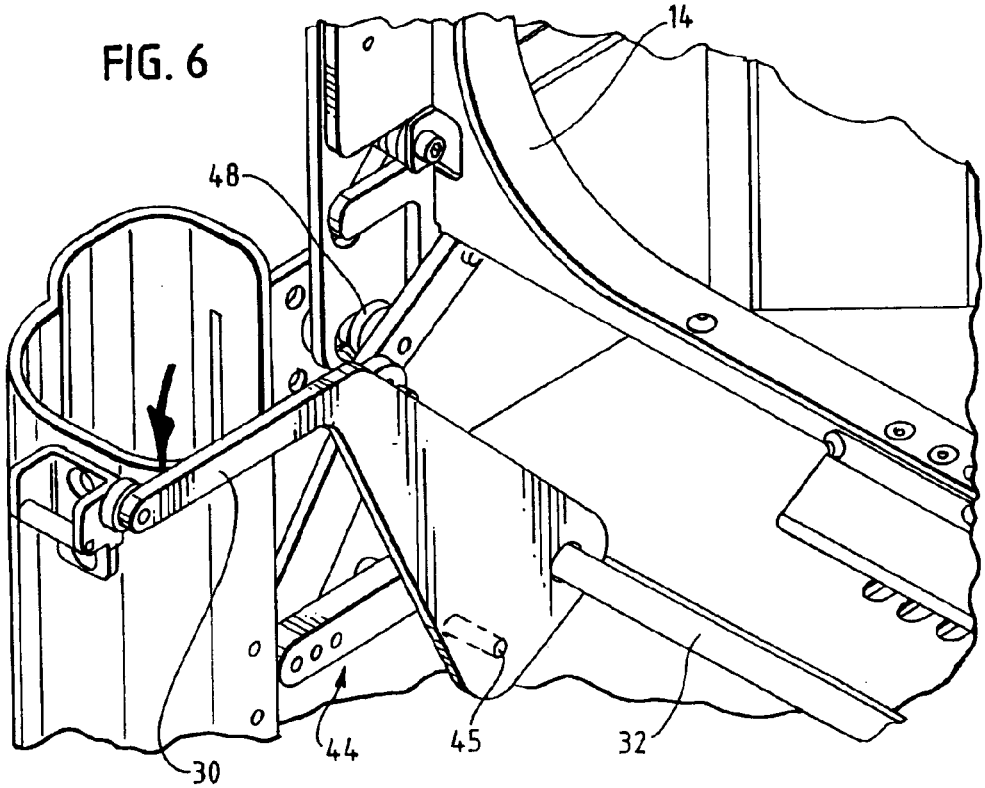
FIG. 6 is an enlarged view of the contact arm and showing the linkage between and interaction between the contact arm and the chute track system with the contact arm (and track system) moving toward the closed position.
Figure 7:
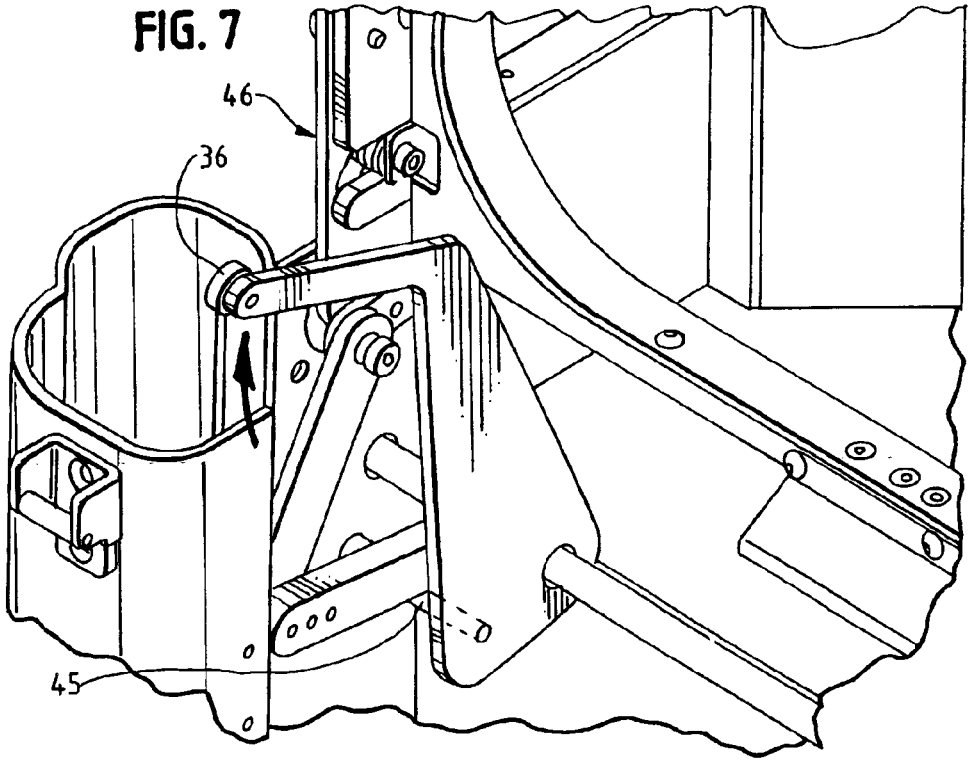
FIG. 7 is a view similar to FIG. 6 with the contact arm moving toward the open position.

Referring to FIGS. 3 and 6–7, the torsion bar 32 includes a linkage 44 that operably contacts the arm 30 by means of a pin (or screw) 45 that is mounted in the arm 30. The pin 45 engages and "pushes" the linkage 44 upwardly. A chute track system 46 opens the chute 14 by action of the pin 45 upwardly urging the linkage 44. FIGS. 6–7 illustrate the linkage 44 which includes a roller 48 (see FIGS. 14–15) that rides in an elongated slot 50 in the chute track system 46 for, as will be discussed below, moving the track system 46 between the open and closed positions. For purposes of the discussion that follows, the open position will be referred to as that position in which the chute 14 is open and the strap is allow to be pulled from or removed from the chute 14 and the closed position will be referred to as the position in which the chute 14 is "closed" for conveying the strap through the chute 14.

Referring now to FIGS. 13–20, the chute 14, as will be recognized by those skilled in the art, defines a generally rectangular track (with rounded corners) about which the strap is conveyed. The track includes a novel release system 51 formed, in part, by a lip 52 that defines an inner wall against which the strap is guided as it moves around the chute 14 and a flange 54 that is typically formed as part of and outwardly of the lip 52. To this end, the lip 52 and flange 54 are essentially an integral unit.

The flange 54 is mounted to a frame portion 56 of the chute 14. The flange 54 is mounted to the chute frame 56 such that it is movable relative to the chute frame 56 transverse to the direction of conveyance of the strap. In a present embodiment, the flange 54 (and chute 14) are mounted to the chute frame 56 by a plurality of springs 58 that bias the chute 14 to the closed position.

The flange 54 includes a plurality of rollers 60 mounted thereto that extend outwardly (in a transverse direction) from the flange 54. The rollers 60 are positioned in horizontal slots or channels 62 in the frame 56 to guide the movement of the chute 14 (i.e., the flange 54 and lip 52) between the open and closed positions. To assure smooth movement of the chute 14, four rollers 60 are provided, one at about each of the corners of the chute 14.

As will be appreciated from the figures, the slots 62 in the frame 56 provide a path for moving the chute 14 forward and back (i.e., between the open and closed positions). In order to urge or drive the chute 14 forward and back, the chute track system 46 includes a pair of drive bars 64, one each positioned at about opposite sides of the chute frame 56. Referring to FIGS. 15 and 18–20, each of the drive bars 64 is positioned on a side of the frame 56 such that the bars 64 each cooperate with the chute flange rollers 60 that traverse in the frame horizontal slots 62. The drive bars include inclined slots or channels 66 into which the rollers 60 insert. In this manner, each roller 60 engages both a transverse (or horizontal) frame slot 62 and an inclined drive bar slot 66. The drive bars 64 are mounted to the frame 56 by pins 68 that permit up and down, reciprocating movement (relative to the frame 56) but restrain the bars 64 from any transverse movement.

Figure 18:
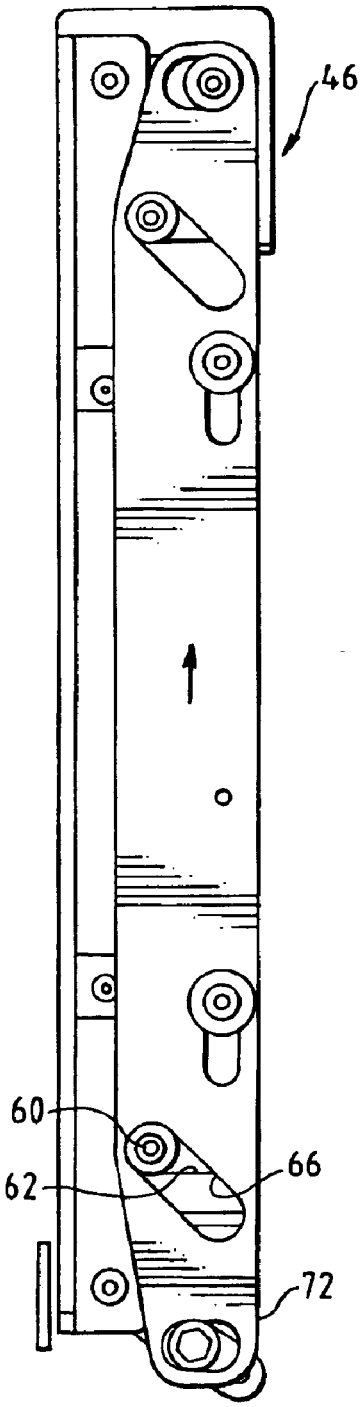
FIGS. 18–20 are views taken along line 18—18 of FIG. 14, showing the track system in the closed (operating) position in FIG. 18, as the chute track is moved toward the release position in FIG. 19, and in the open or release position in FIG. 20.
Figure 19:
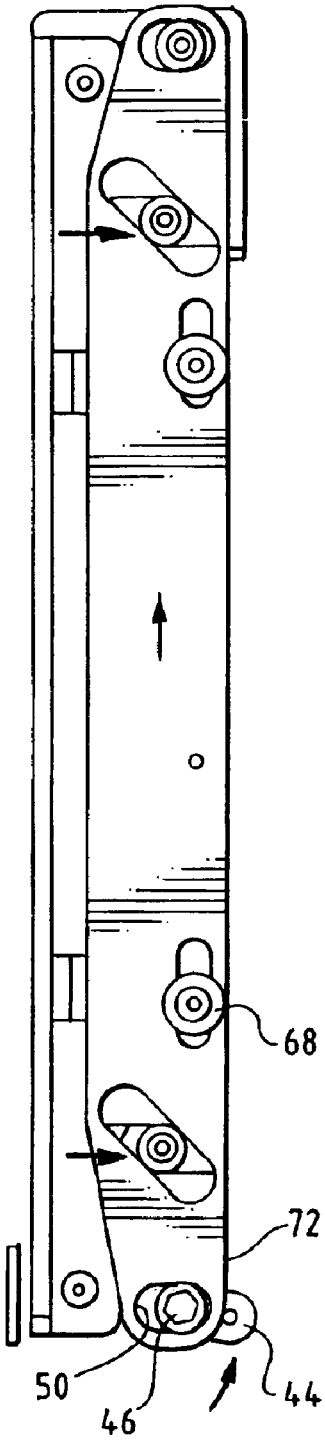
Figure 20:
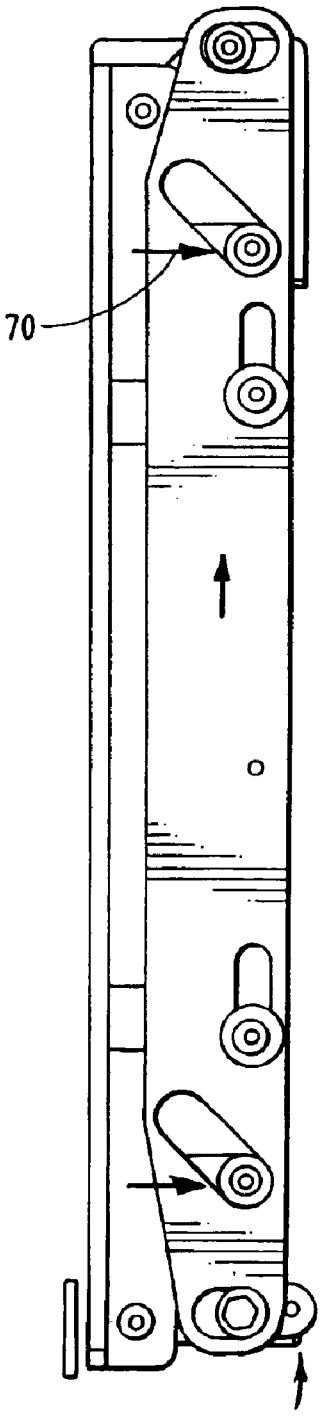
Figure 21:
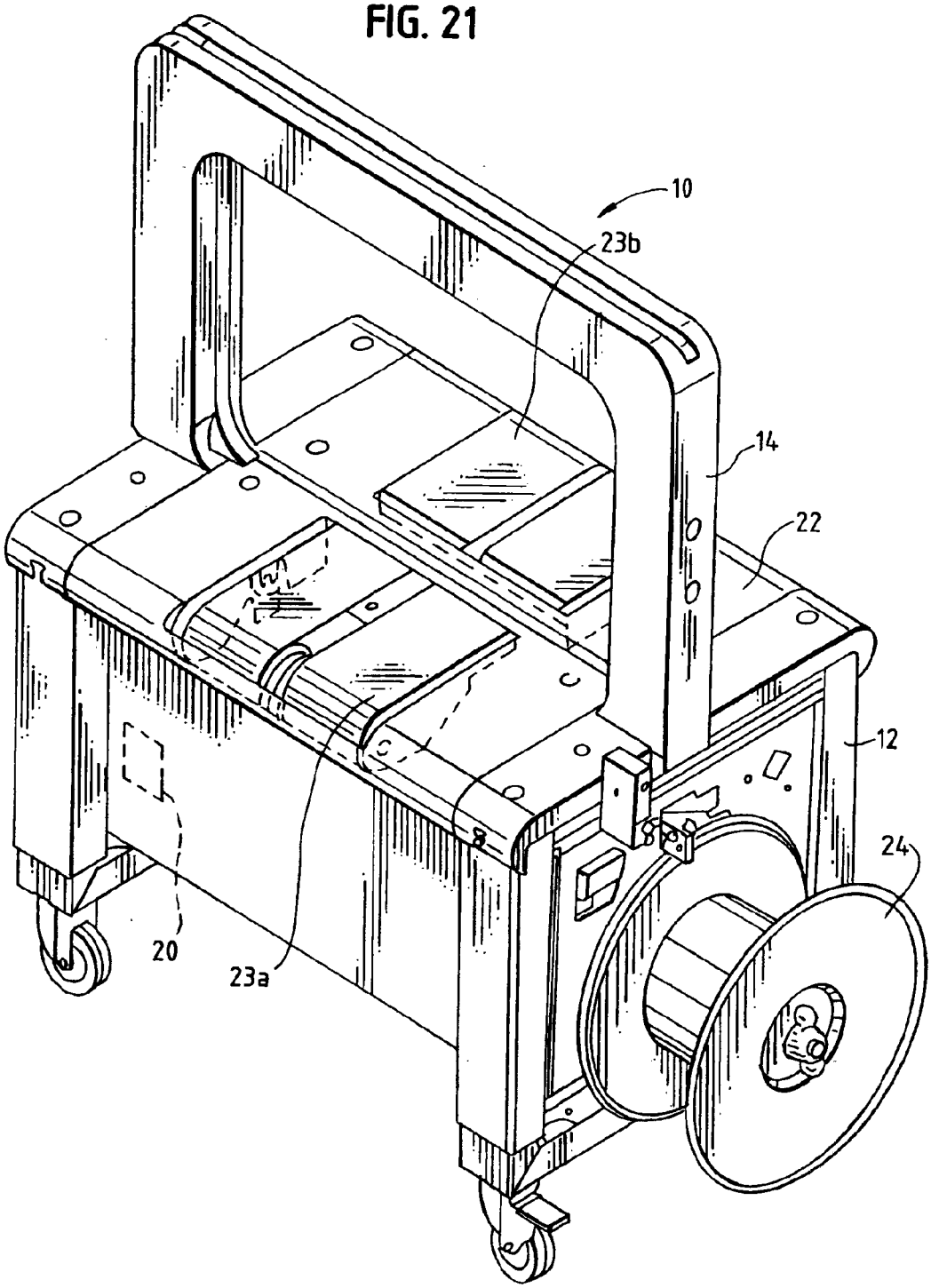
FIG. 21 is a perspective view of an exemplary strapping machine illustrating the removable conveyors embodying yet another aspect of the present invention.
Figure 22:
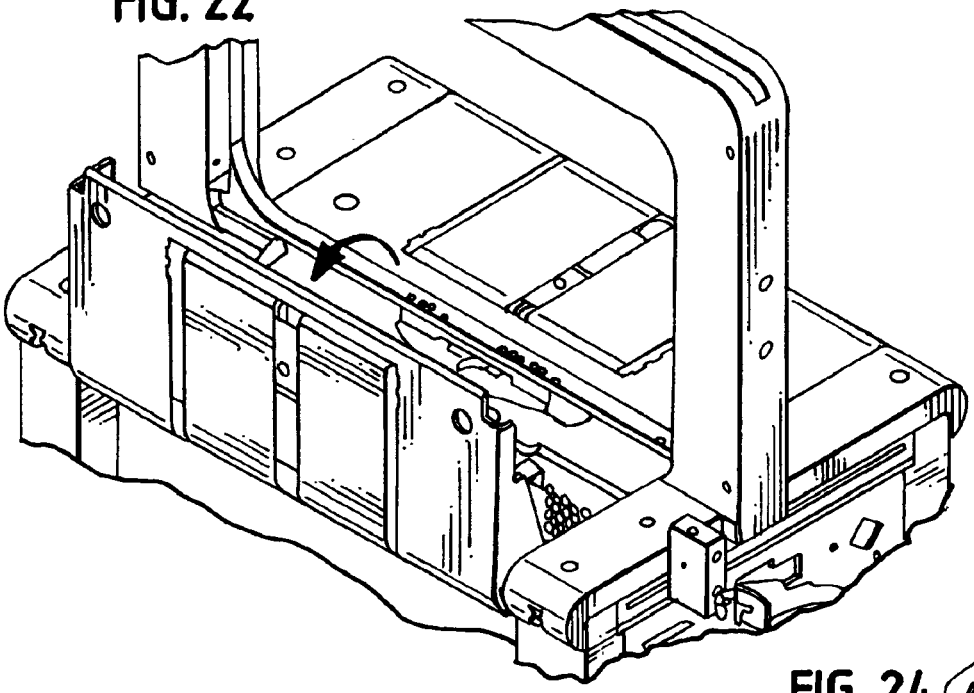
FIG. 22 is a perspective view of the strapping machine illustrating the in-feed conveyor pivoted upwardly for removal.
Figure 23:
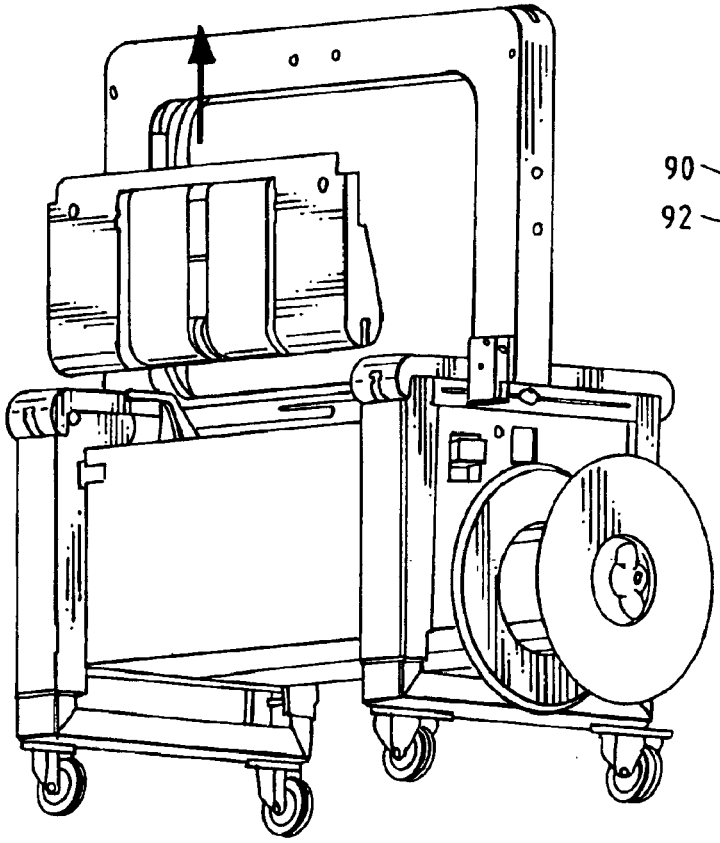
FIG. 23 is another perspective view of the machine showing the conveyor lifter from the machine.
Figure 24:
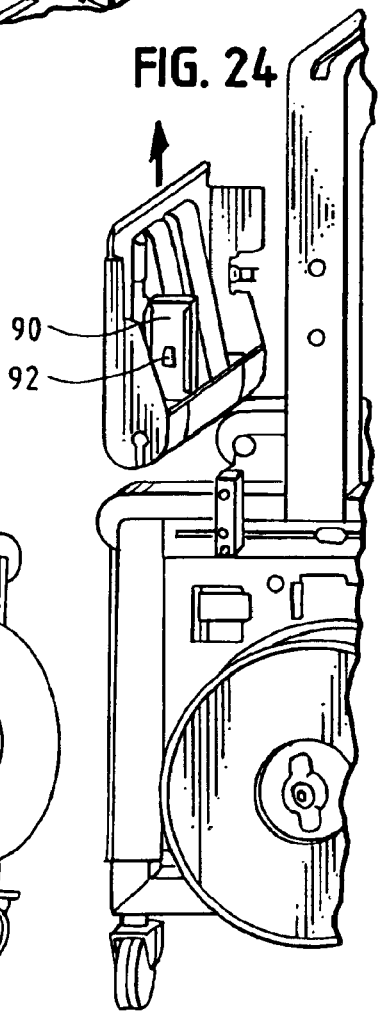
FIG. 24 is a side view of the machine of FIG. 23.

Referring to FIGS. 14–20, the operation of the chute track system 46 is relatively straightforward. It should, however, be recognized that the views as seen in FIGS. 18–20 are reversed from those of FIGS. 14–17. That is in FIGS. 14–17, movement of the chute 14 to the open position is shown by the directional arrow at 70, whereas that same movement in FIGS. 18–20 is in an opposite direction, as shown by directional arrow 70 in those figures.

In the closed position, the drive bar 64 is down (see FIG. 18), and the chute 14 overlies the weld head 18. In this position, the strap is conveyed around the chute 14. When, during the course of the strapping operation, the chute 14 is moved to allow the strap to be tensioned onto the load (and also when the work surface 22 is opened as to carry out maintenance), the drive bar 64 is urged or driven in an upwardly direction. In that the drive bar 64 is constrained to move only upwardly and downwardly (by the pins 68), the chute rollers 60, which are positioned in the drive bar inclined slots 66, are urged to move both forward and up. However, in that the chute rollers 60 are constrained to move only forward and rearward (by the frame horizontal slots 62), the chute 14 is urged forwardly, away from the strap path 26. This releases the strap from the chute 14, and opens the path 26 (e.g., moves the chute 14 to the open position). As set forth above, the chute 14 is biased to the closed position, and, as such, once the driving force (for moving the drive bars 64 to the open position) is removed, the bars 64 and the chute 14 return to the closed position.

Figures 14, 15, 16, 17:
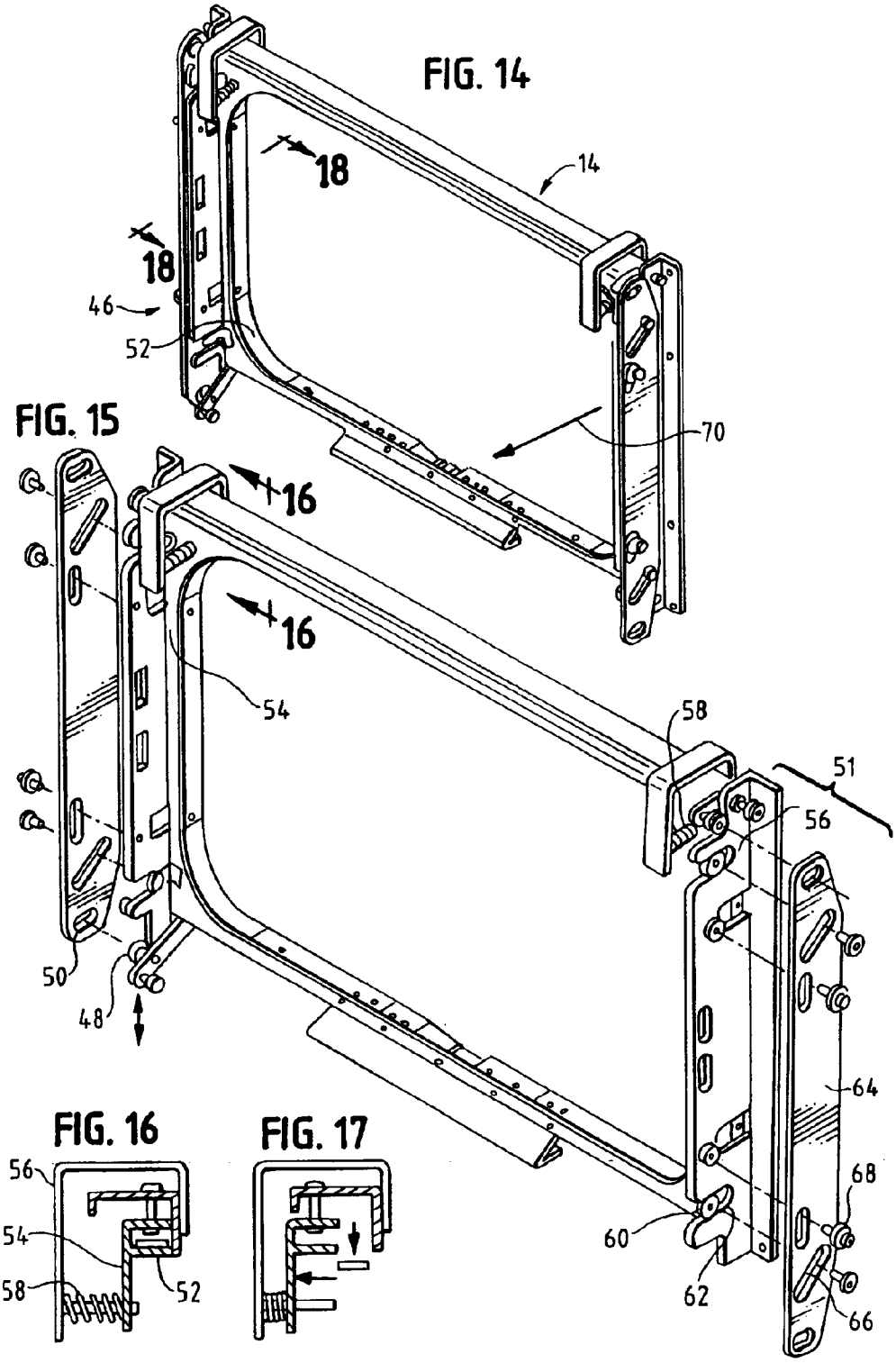
FIG. 14 is a perspective view of the chute track system shown removed from the strapping machine.
FIG. 15 is an exploded view of the chute track system.
FIG. 16 is a cross-sectional view taken along line 16—16 of FIG. 15 in which the chute track is shown in the closed or operating position.
FIG. 17 is a cross-sectional view as would be taken along line 16—16 of FIG. 15 when the chute track is in the open or release position.

Referring now to FIGS. 18–20, and as can be seen in FIGS. 14 and 15, a lower part 72 of the drive bar 64 includes a slotted opening 50 that is operably connected to the contact arm linkage 44. The roller 48 that is mounted to the linkage 44 rides within the slotted opening 50. As such, as the linkage 44 moves up and down, it provides the driving force for movement of the drive bar 64. Thus, when the work surface 22 is opened, as the contact arm 30 moves up, the linkage 44 imparts a likewise upward movement to the drive bar 64 to open the chute 14. As will be appreciated by those skilled in the art, this upward movement is also provided during regular strapper operation when the strapper 10 cycle is at that point at which the strap is released from the chute 14 by movement of the chute 14 to the open position.

Figure 25:
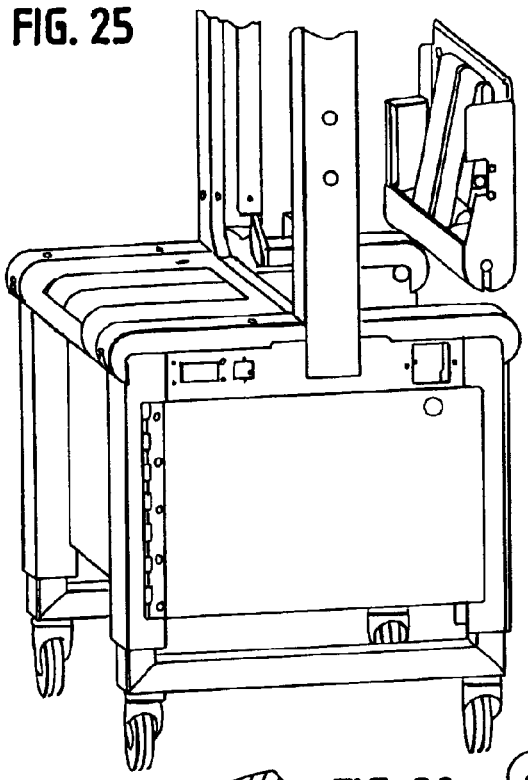
FIG. 25 is a perspective view of the machine showing the out-feed conveyor pivoted upwardly and removed from the machine.
Figure 26:
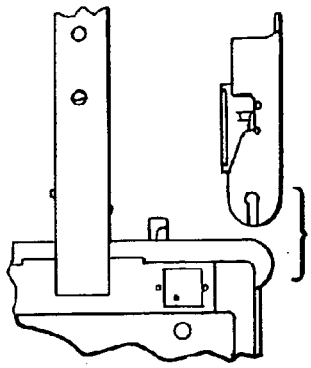
FIG. 26 is a side view showing the out-feed conveyor removed.
Figure 27:
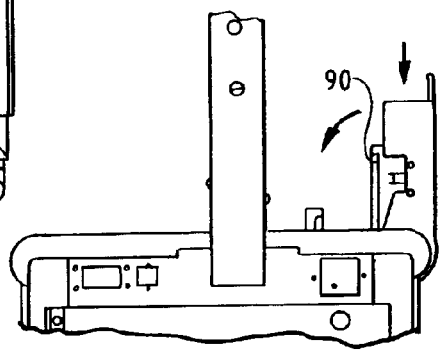
FIG. 27 is a side view similar to FIG. 26 illustrating the conveyor being positioned on the machine.
Figure 28:
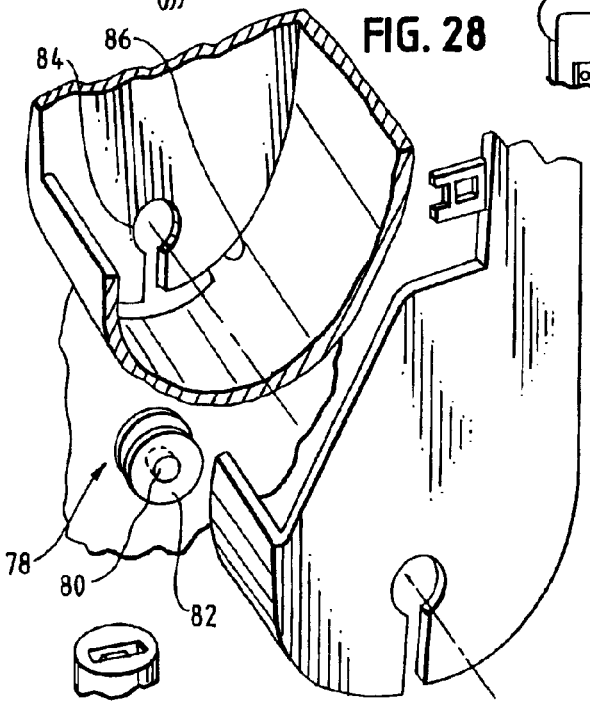
FIG. 28 is an enlarged, partial view of the hinge and in-feed conveyor interlock.
Figure 29:
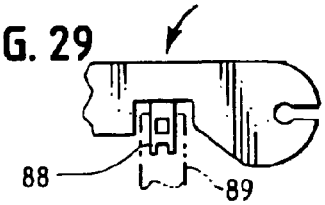
FIG. 29 is a side view showing the interlock key inserted in the interlock body.
Figure 30:
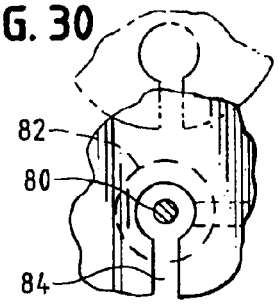
FIG. 30 is a side view illustrating the hinge assembly.
Figure 31:
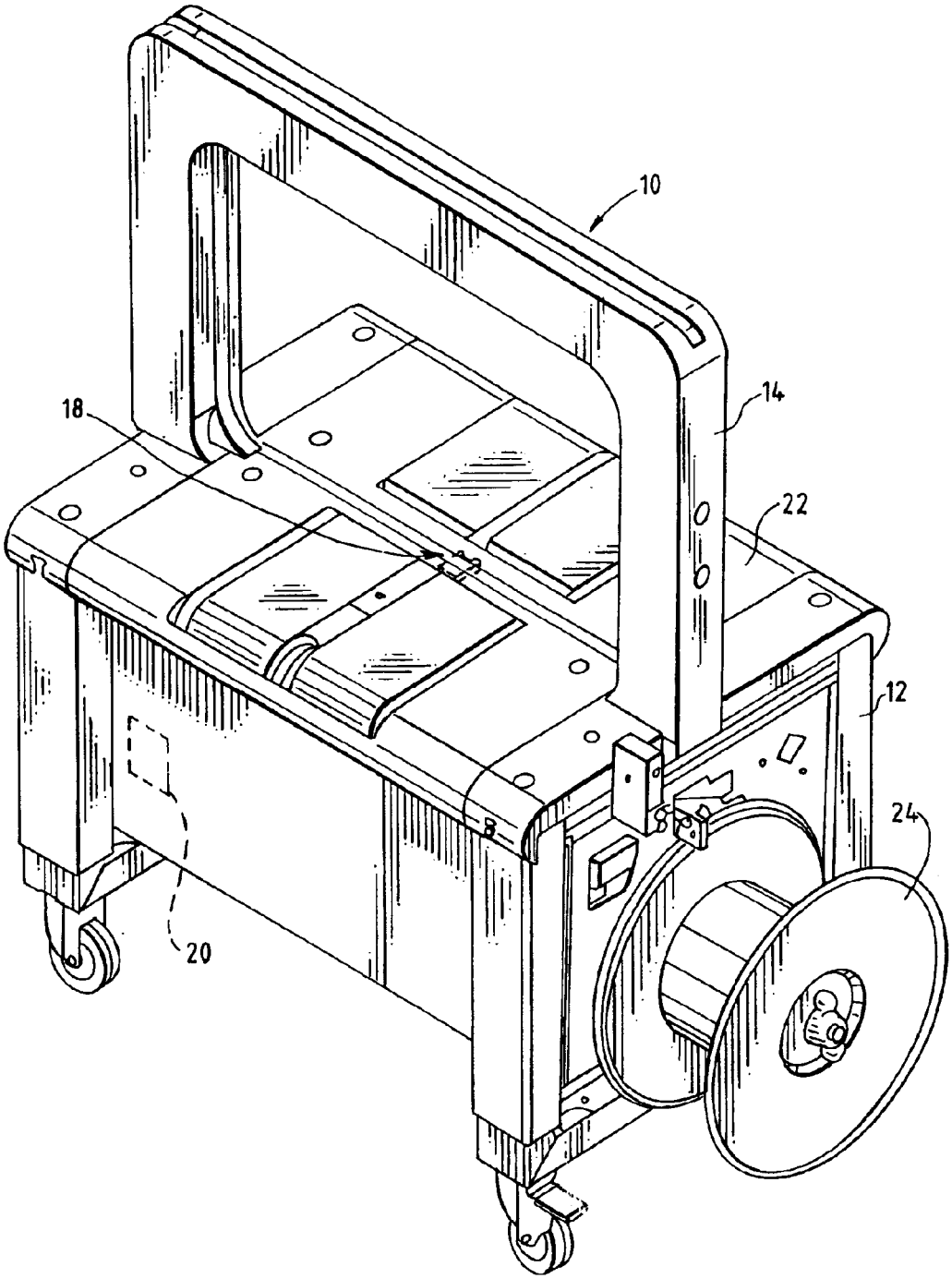
FIG. 31 is a perspective view of an exemplary strapping machine illustrating the location of the pivoting welding head embodying another aspect of the present invention.
Figure 32:
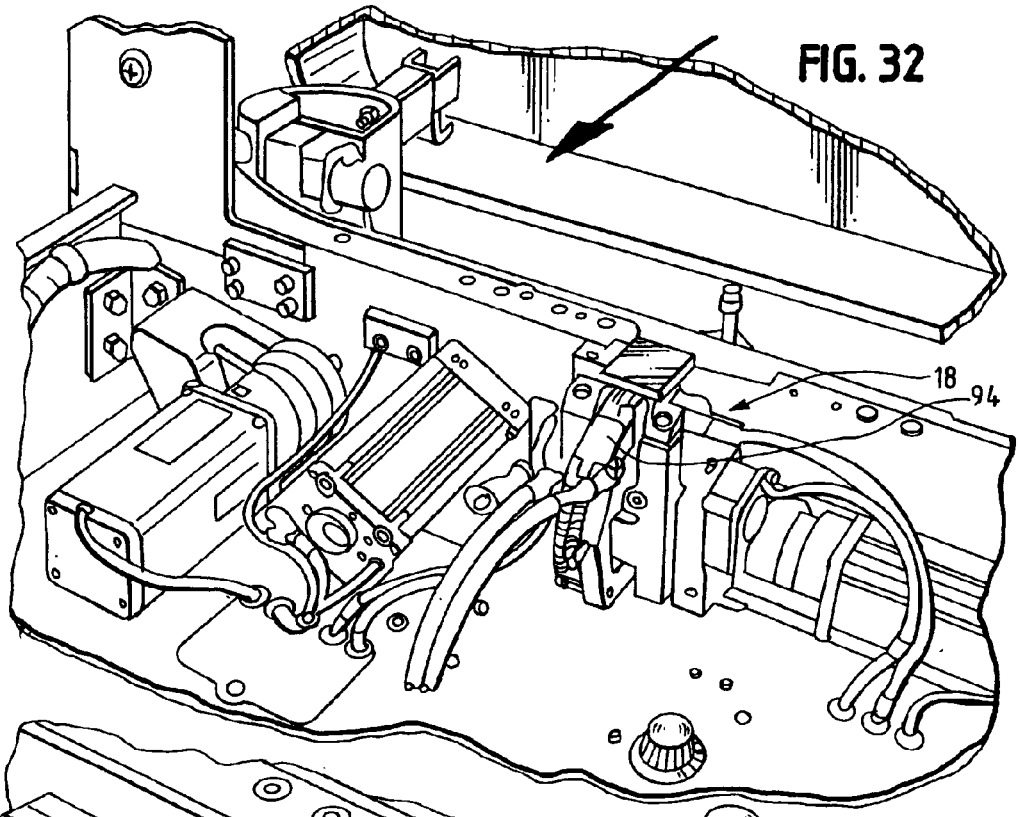
FIG. 32 is an enlarged partial view of the interior of the strapping machine, showing the welding head with the blade in the operating position.
Figure 33:
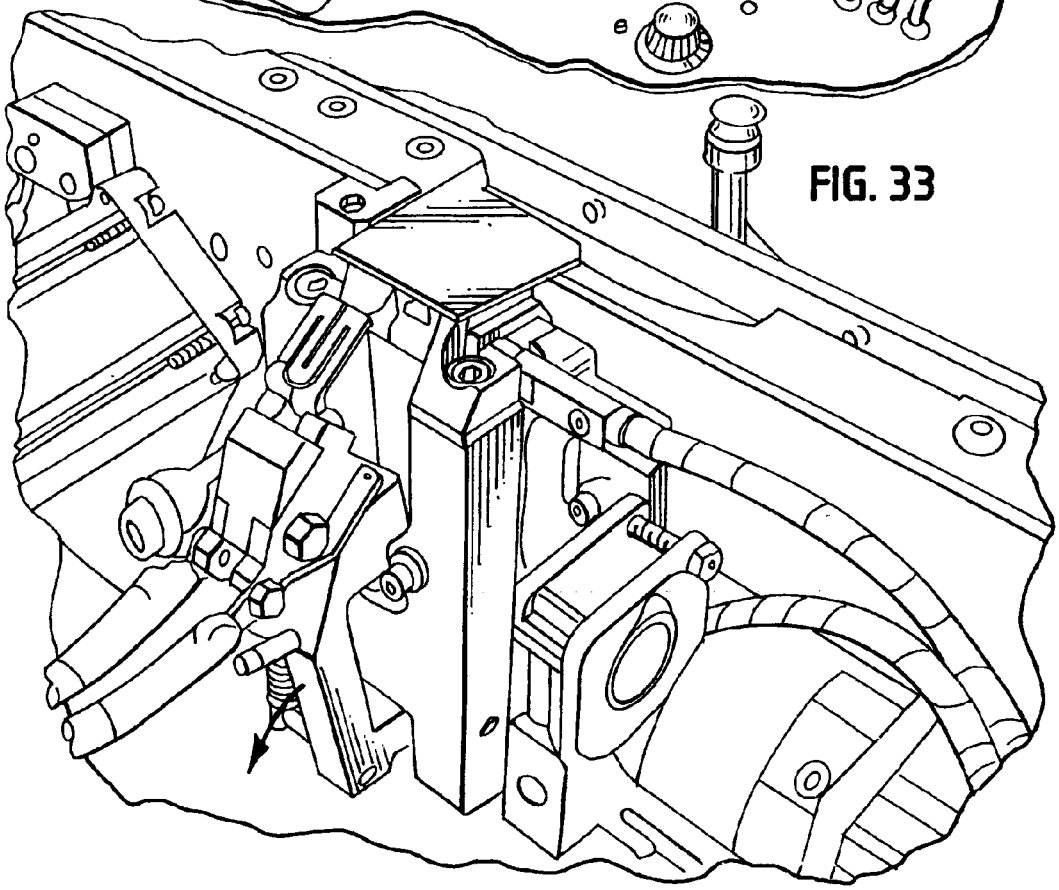
FIG. 33 is a view similar to FIG. 32 showing the blade cradle leaned rearwardly to position the blade in the service (or cleaning) position.
Figure 34:
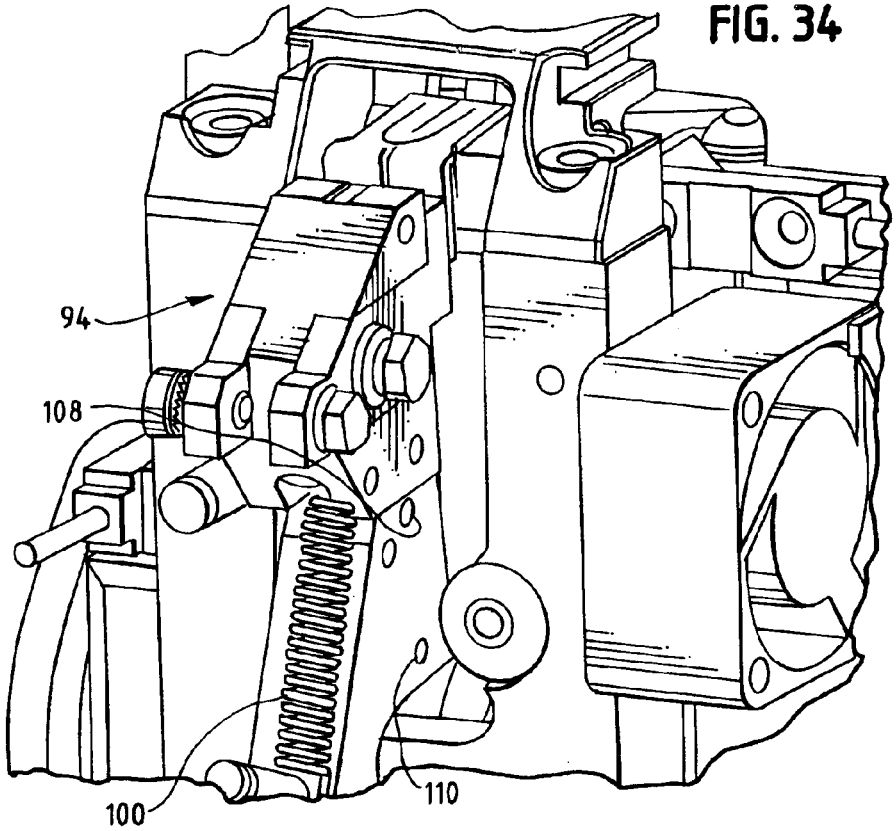
FIGS. 34 and 35 are different views of the blade in the operating position.
Figure 35:
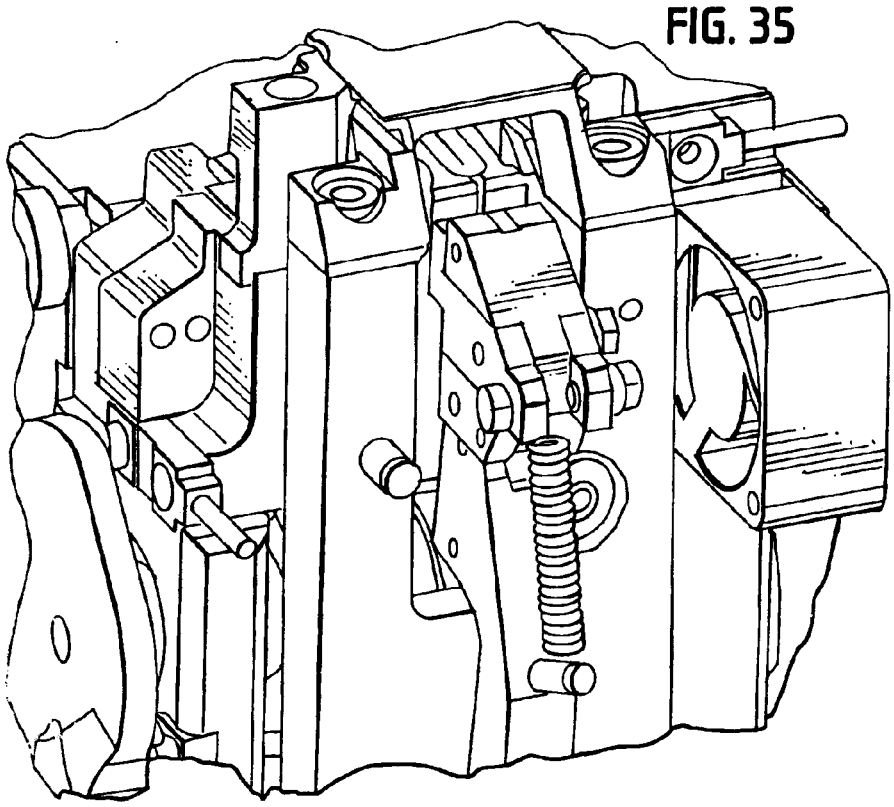

Advantageously, the present strapper 10 includes removable or lift-off conveyors 23*a,b*. As seen in FIGS. 21–30, the in-feed and out-feed conveyors 23*a,b* (which are configured as part of the work surface 22) are mounted to the machine frame 12 by hinge pins 78 (see FIGS. 28 and 30) that include a pin portion 80 and a centering flange 82 mounted to the end of the pin portion 80. The pin portion 80 provides the pin or post about which the surface 22 (or conveyor 23*a,b*) rotates and the flange 82 assures that the surface 22 (or conveyor 23*a,b*) is aligned with the machine frame 12 for proper installation. The surface 22 (or conveyor 23*a,b*) includes an elongated slot 84 that extends beyond an outward edge 86 of the surface 22 or conveyor 23*a,b* that is configured for sliding onto the hinge pin 78. As seen in FIGS. 25, 26 and 30, the slot 84 extends downwardly when the conveyor 23*a,b* is pivoted up, so that the conveyor 23*a,b* can be lifted off of the machine 10. And, when the surface 22 or conveyor 23*a,b* is pivoted downwardly to the closed or operating position the slot 84 is oriented "outwardly" of the surface 22 or conveyor 23*a,b*. As shown in FIGS. 25–29, an interlock (having a body 89 and a key 88) can be provided to isolate power to the conveyor 23*a,b* when the conveyor 23*a,b* is pivoted from the operating position.

A present strapping machine 10 is preferably fitted with fully automatic conveyors 23*a,b*. That is, the conveyors 23*a,b* can operate to feed a load into the machine 10, strap the load and remove the load from the machine 10, without operator action. To this end, the conveyors 23*a,b* are preferably supplied with DC motors 90 that are small in size, light-weight and readily adapted for use with fully automated machine control systems 20. Quick-connect electrical connectors 92 are preferably used to permit readily replacing the motors 90 to, for example, conduct maintenance or the like.

Figure 36:
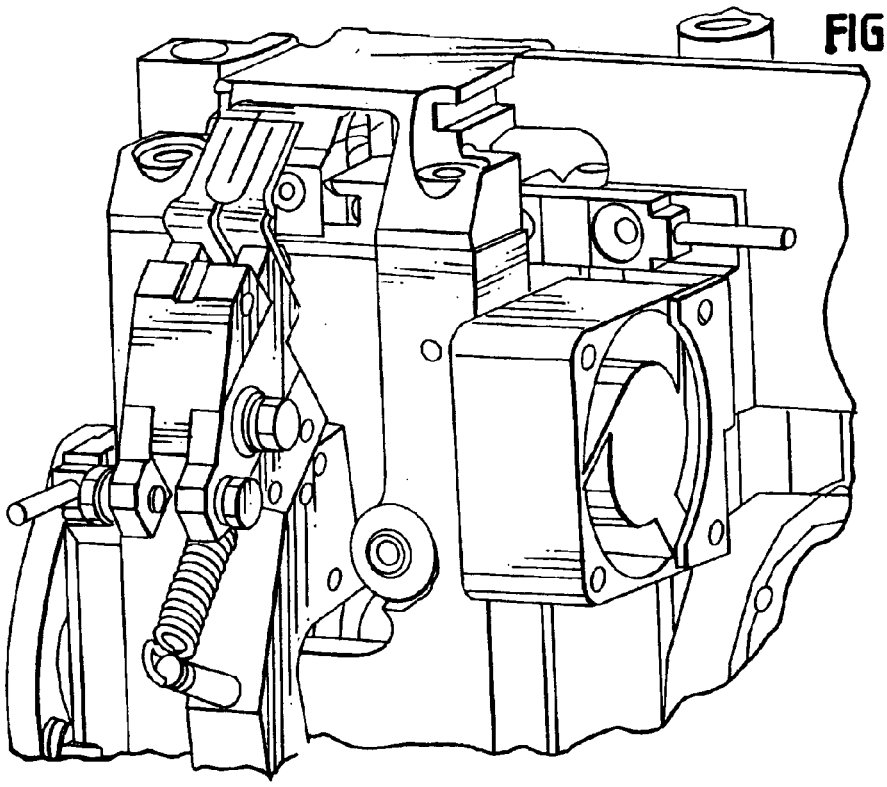
FIGS. 36 and 37 are different views of the blade in the service position.
Figure 37:
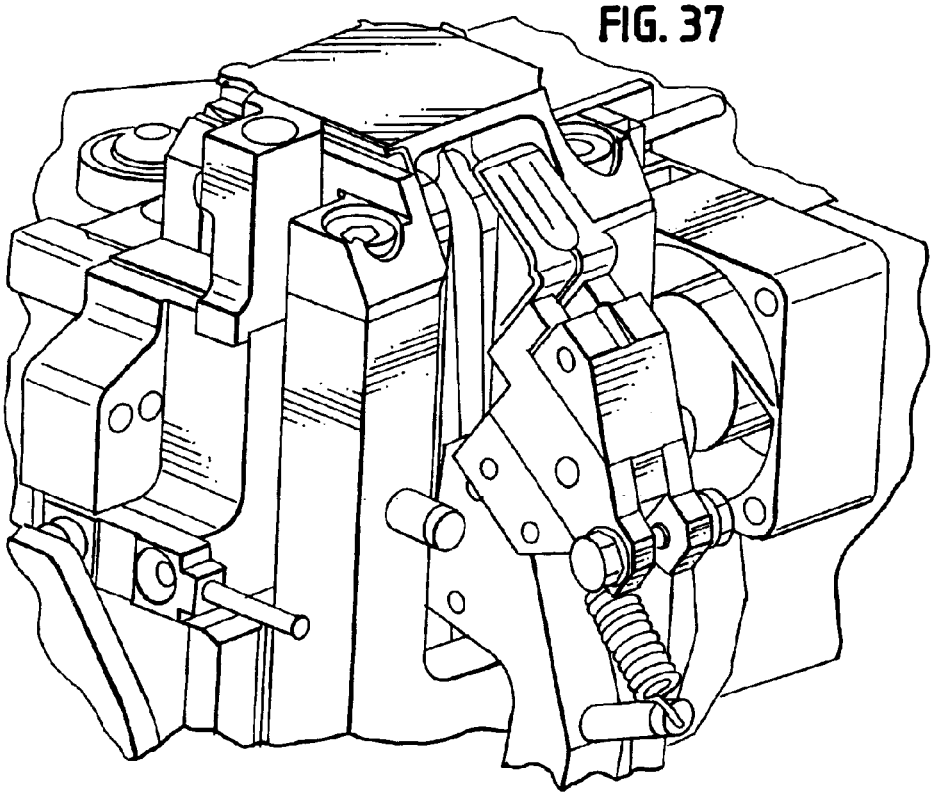
Figure 38:
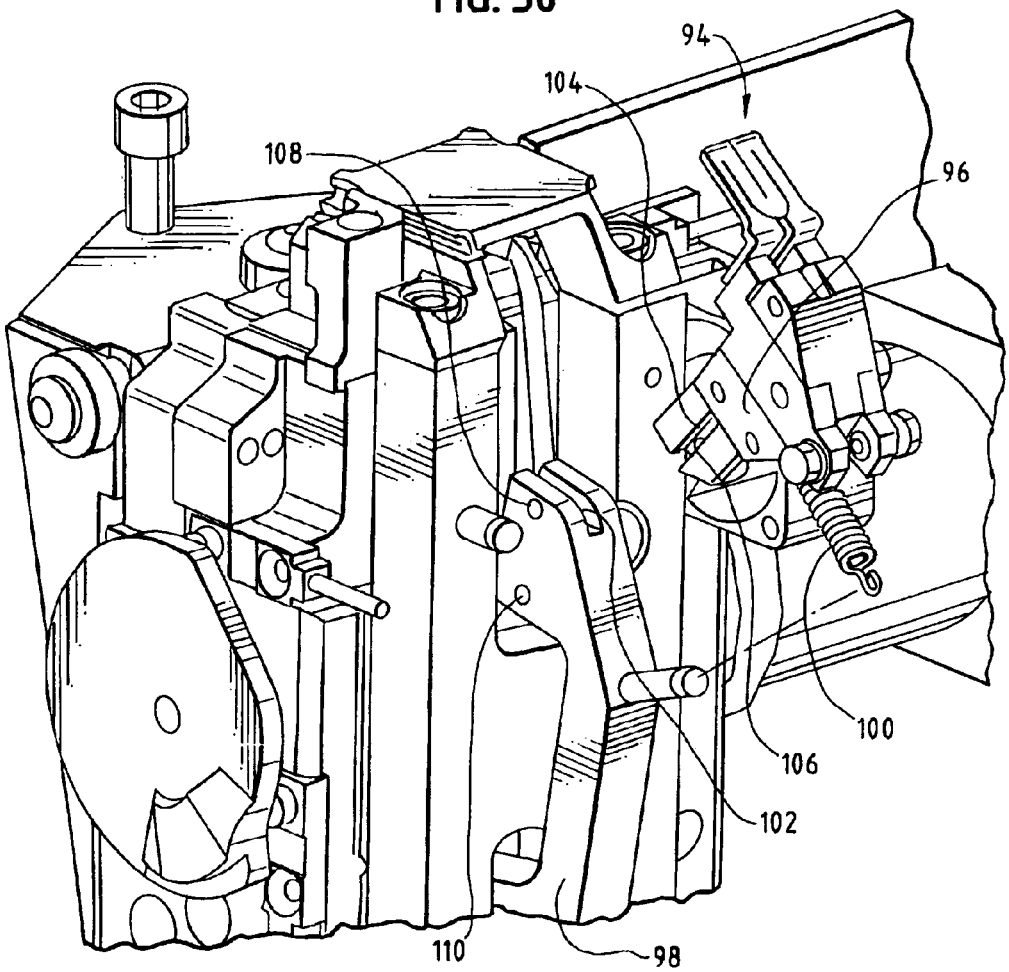
FIG. 38 is a perspective view of the blade removed from the cradle to, for example, move the blade from the operating position to the service position.

Referring now to FIGS. 31–38, to further reduce machine 10 "downtime" to, for example, maintain the weld head 18, the present machine 10 includes a pivoting weld blade 94. Unlike known strapping machines that use a fixed mounting with threaded fasteners and the like, the present strapper 10 uses a weld blade 94 that is mounted to a slotted carrier 96 that is, in part, pivotally mounted to a blade arm 98. Referring to FIG. 38, the blade 94 is fixedly mounted to the slotted carrier 96 which is held in place on the blade arm 98 by a spring 100. The arm 98 includes a channel 102 that is configured to receive the carrier 96. The carrier 96 includes a depending insert 104 that has a slot 106 formed therein.

To assure that the carrier 96 is properly aligned in the arm channel 102, two fixed pins 108, 110 extend through the arm 98, across the arm channel 102. The pins 108, 110 are positioned so that the carrier slot 106 fits over the pins 108, 110 to locate the carrier 96 on the arm 98. In this manner, the carrier 96 (and thus the blade 94) is properly seated on the arm 98 when the slot 106 is fitted over the pins 108, 110. The spring 100 (which extends between the carrier 96 and the arm 98) creates a tension that maintains the carrier 96 properly seated on the arm 98.

As seen in FIGS. 36 and 37, the two pin configuration, in addition to securing the carrier 96 in the operating position, also permits securing the carrier 96 (and blade 94) in a cleaning or service position in which it is accessible (i.e., leaned rearwardly and exposed) to permit, for example, cleaning the blade 94 as by wiping with an abrasive cloth or the like. The carrier 96 is maintained in the cleaning or service position by inserting the carrier 96 onto the arm 98 with the carrier slot 106 inserted over the upper pin 108 only. Again, the carrier 96 is maintained in this position by the tension exerted by the spring 100 on the carrier 96.

The present strapping machine 10 is also configured to permit readily adjusting the height of the machine 10 to fit within a pre-configured process (if, for example, the machine 10 is to operate in a fully automatic mode) or to accommodate operators of different heights. Referring to FIGS. 39–42, the machine 10 includes a pair of height adjustment assemblies 112, each operably connecting the machine frame 12 to a leg assembly 114. Each leg assembly 114 is formed having a generally square cornered U-shape, with a caster or wheel 116 positioned at the corners of the U-shaped element 114.

Each side of the adjusting assembly 112 (for purposes of the present disclosure, the machine 10 includes two adjusting assemblies 112, one on each side of the machine 10) includes a pair of elongated threaded rods 118 that are mounted for rotation (but not threading) at the work surface 22. Each rod 118 is threaded in to an adjusting nut 120 that is retained in the leg assembly 114. In a present embodiment, the rods 118 are secured (for rotation) at the work surface 22 by a bronze bushing 122 and the adjusting nut 120 is a bronze nut. The nut 120 is held or retained in the leg assembly 114 by a nut retainer 124 that is affixed to the leg assembly 114. Rotation of the rod 118 (from the top of the work surface 22) is facilitated by an opening in the work surface 22, through which a hex head 126 (of the rod 118) is accessible (see FIG. 41).

To permit the adjustment (i.e., raising and lowering) of both of the sides of each leg assembly 114 the height adjustment assembly 112 can include a sprocket 128 mounted to the bottom of each rod 118 and chain (not shown) or like linking assembly that extends between the sprockets 128 so that rotation of one of the threaded rods 118 rotates the other rod 118. It is anticipated that such an arrangement will permit more readily and more quickly adjusting the height of the machine 10 and will permit height adjustment without twisting the machine frame 12.

Figure 39:
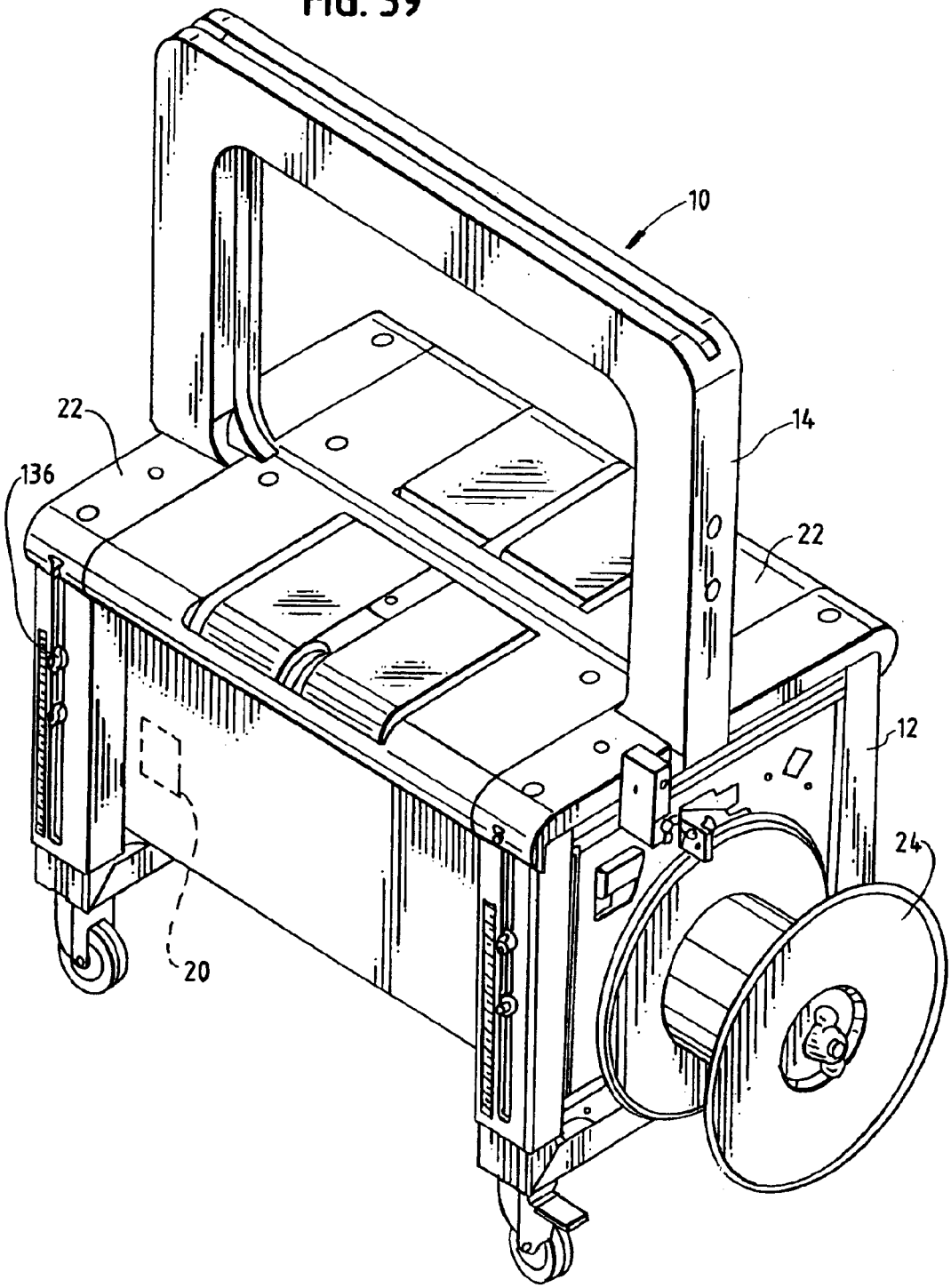
FIG. 39 is a perspective view of an exemplary strapping machine illustrating the table height adjustment assembly embodying another aspect of the present invention.
Figure 40:
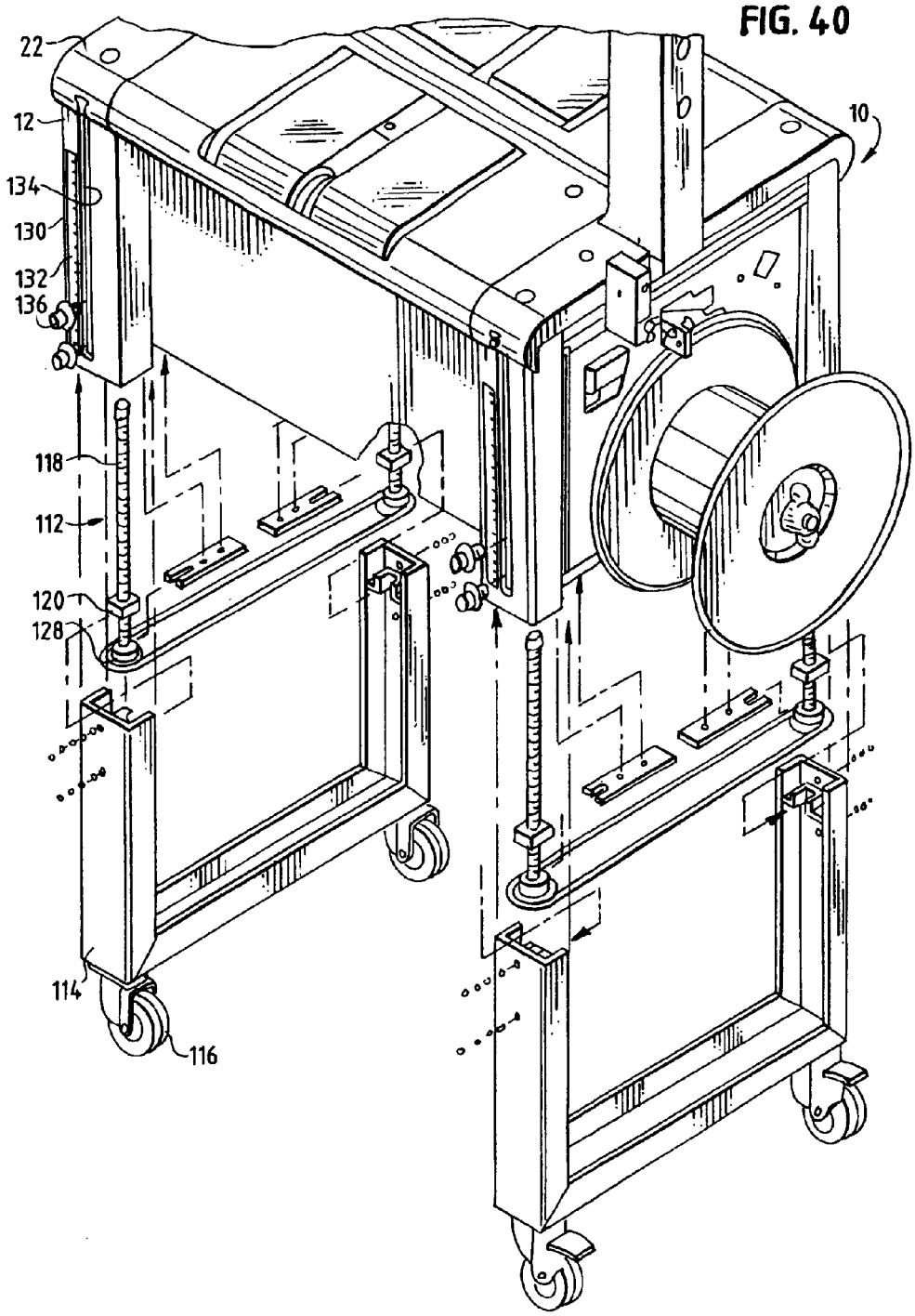
FIG. 40 is an exploded view of the strapping machine of FIG. 39.
Figure 41:
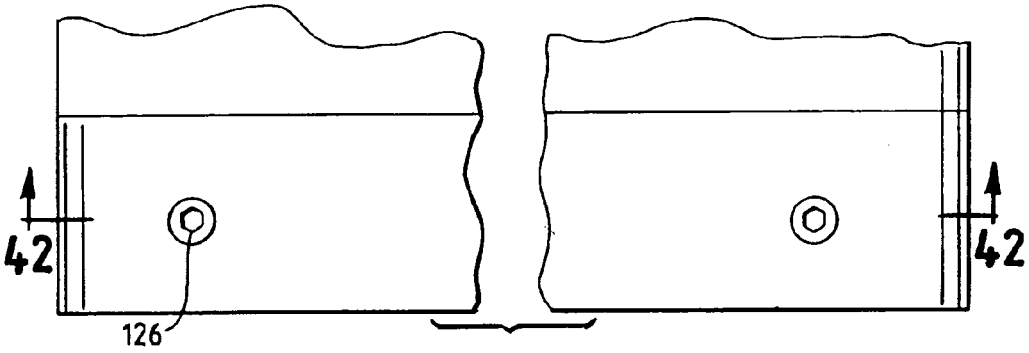
FIG. 41 is a top view of the work surface showing the adjusting nuts.
Figure 42:
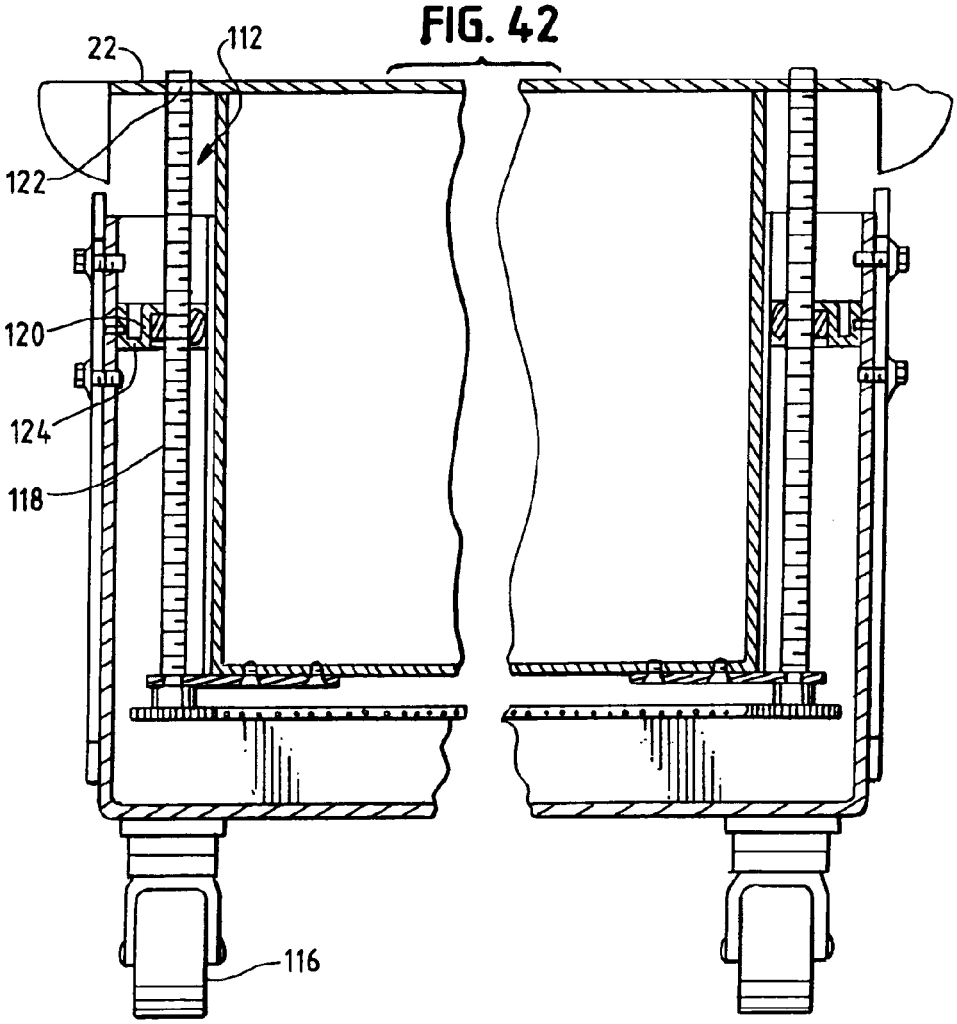
FIG. 42 is a cross-sectional view taken along line 42—42 of FIG. 41.

To further facilitate the adjustment of the machine 10 height, the height adjustment assembly 112 includes a machine height indicator 130. As seen in FIG. 39, the indicator 130 includes a reverse scale 132 (that is the scale 132 has the lower numbers at a higher position on the machine frame 12), and an opening or slot 134 in the frame 12 through which an indicating pointer 136 extends. The indicating pointer 136 is fixedly mounted to the leg assembly 114 such that as the frame 12 is raised or lowered relative to the leg assembly 114, the height of the frame 12 relative to the leg assembly 114 is indicated by the position of the indicating pointer 136 along the scale 132.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover all such modifications as fall within the scope of the claims.

What is claimed is:

1. A strapping machine configured to feed a strapping material around a load, position, tension and seal the strapping material around the load, the strapping machine comprising:

a machine frame;

a work surface mounted to the frame for supporting the load in the strapping machine;

a strap chute mounted to the frame for carrying the strap around the load and for releasing the strap material from the strap chute;

a feed assembly configured to convey the strap around the strap chute and to retract and tension the strap around the load; and a weld head for sealing the strap to itself, the welding head being disposed, at least in part, below the work surface;

the work surface defining an in-feed surface on one side of the strap chute and an out-feed surface at an opposite side of the strap chute, the in-feed and out-feed surfaces separated from one another by a lower portion of the strap chute, at least one of the in-feed and out-feed surfaces including an integral conveyor for feeding the load into the strapping machine or out of the strapping machine, the conveyor being integral with a hinged work surface portion, wherein the hinged work surface portion is pivotal upwardly and outwardly from about the lower portion of the strap chute and wherein the hinged work surface portion is removable, without tools, when in an upwardly pivoted orientation, the hinged work surface portion being pivotal about a pair of hinges, each hinge including a hinge pin disposed on the frame engageable with a hinge opening in the work surface portion.

2. The strapping machine in accordance with claim 1 wherein the hinge pin includes a pin stub and a centering flange at an end of the hinge pin stub and wherein the work surface portion includes a hinge opening for receiving the hinge pin stub and an elongated slot contiguous with the hinge opening for receiving the centering flange.

3. The strapping machine in accordance with claim 1 wherein the integral conveyor includes a conveyor belt and a conveyor motor mounted to the work surface.

4. The strapping machine in accordance with claim 3 wherein the motor includes electrical connections and wherein the electrical connections are provided on a quick disconnect fitting.

5. A strapping machine configured to feed a strapping material around a load, position, tension and seal the strapping material around the load, the strapping machine comprising:

a machine frame;

a work surface mounted to the frame for supporting the load in the strapping machine;

a strap chute mounted to the frame for carrying the strap around the load and for releasing the strap material from the stray chute;

a feed assembly configured to convey the strap around the strap chute and to retract and tension the strap around the load; and a weld head for sealing the strap to itself, the welding head being disposed, at least in part, below the work surface;

the work surface defining an in-feed surface on one side of the strap chute and an out-feed surface at an opposite side of the strap chute, the in-feed and out-feed surfaces separated from one another by a lower portion of the strap chute, the in-feed and out-feed surfaces each including an integral conveyor for feeding the load into the strapping machine or out of the strapping machine, the conveyors being integral with their respective hinged work surface portions, wherein the hinged work surface portions are pivotal upwardly and outwardly from about the lower portion of the strap chute and wherein the hinged work surface portions are removable, without tools, when in an upwardly pivoted orientation, the hinged work surface portions being pivotal about a pair of hinges, one on each side of each work surface portion, each hinge including a hinge pin disposed on the frame engageable with a hinge opening in the work surface portion, each hinge pin including a pin stub and a centering flange at an end of the hinge pin stub and wherein the work surface portions each include a hinge opening for receiving the hinge pin stub and an elongated slot contiguous with the hinge opening for receiving the centering flange.

6. The strapping machine in accordance with claim 5 wherein the integral conveyors each include a conveyor belt and a conveyor motor mounted to the work surface.

7. The strapping machine in accordance with claim 6 wherein the motors include electrical connections and wherein the electrical connections are provided on a quick disconnect fitting.

* * * * *

UNITED STATES PATENT AND TRADEMARK OFFICE

CERTIFICATE OF CORRECTION

PATENT NO. : 6,955,119 B2
DATED : October 18, 2005
INVENTOR(S) : Bobren et al.

It is certified that error appears in the above-identified patent and that said Letters Patent is hereby corrected as shown below:

Column 10,
Line 41, should read -- from the strap chute --.

Signed and Sealed this

Tenth Day of January, 2006

JON W. DUDAS
*Director of the United States Patent and Trademark Office*